US006712443B2

(12) United States Patent
Kanda et al.

(10) Patent No.: US 6,712,443 B2
(45) Date of Patent: Mar. 30, 2004

(54) INK JET RECORDING APPARATUS AND INK JET RECORDING METHOD

(75) Inventors: Hidehiko Kanda, Kanagawa (JP); Jiro Moriyama, Kanagawa (JP); Yoshinori Nakagawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/993,662

(22) Filed: Nov. 27, 2001

(65) Prior Publication Data

US 2002/0063749 A1 May 30, 2002

(30) Foreign Application Priority Data

Nov. 30, 2000 (JP) ..... 2000/365562

(51) Int. Cl.[7] ..... B41J 29/38; B41J 29/393
(52) U.S. Cl. ..... 347/16; 347/19
(58) Field of Search ..... 347/16, 12, 19, 347/14, 101, 15, 98, 11, 9, 43, 41, 10, 58, 20, 57, 56, 54; 400/61, 64, 70, 76, 74

(56) References Cited

U.S. PATENT DOCUMENTS 5,121,142 A * 6/1992 Iwazawa et al. ..... 347/41
5,614,931 A * 3/1997 Koike et al. ..... 347/43
5,696,542 A 12/1997 Matsubara et al. ..... 347/12
6,086,185 A 7/2000 Inui et al. ..... 347/43
6,120,129 A 9/2000 Iwasaki et al. ..... 347/43
6,120,141 A 9/2000 Tajika et al. ..... 347/96
6,241,338 B1 * 6/2001 Otsuki ..... 347/41
6,325,492 B1 12/2001 Koitabashi et al. ..... 347/57

FOREIGN PATENT DOCUMENTS

JP 6-135014 5/1994
JP 6-143618 5/1994

* cited by examiner

*Primary Examiner*—Raquel Yvette Gordon
*Assistant Examiner*—Charles W. Stewart, Jr.
(74) *Attorney, Agent, or Firm*—Fitzpatrick, Cella, Harper & Scinto

(57) ABSTRACT

A recording apparatus is provided with two or more kinds of sub-scanning amounts per main scan, and records a high quality image by reducing the bleeding between colors created characteristically by a multi-pass recording method. The number of times of main scanning to complete an image by a first discharge port array for black ink use and a second discharge port array for color ink use, respectively, are set to be m (m is a positive integer) and n (n is a positive integer) times. With respect to discharge ports to be used for recording in the first and second discharge port arrays, a distance between discharge ports which are positioned at upstream ends of the respective first and second discharge port arrays in the sub-scan direction is made equal to a length of a continuously conveying amount of (m+a) (a is a positive integer) times by combination of the at least two kinds of conveying amounts.

29 Claims, 24 Drawing Sheets

INK JET RECORDING APPARATUS AND INK JET RECORDING METHOD

BACKGROUND OF THE INVENTION

1. Field of the Invention

The present invention relates to an ink jet recording apparatus for recording on a recording material by discharging ink from recording means.

2. Related Background Art

A recording apparatus, which is provided to function as a printer, a copying machine, or a facsimile machine, or used as an output device for a work station or a complex electronics apparatus including a computer or word processor, is structured to record on a recording medium, such as a recording sheet or thin plastic plate, images that include characters, drawings, and the like in accordance with image information including information on characters, drawings, and the like. The recording apparatus is classified into ink jet type, wire-dot type, thermal type, laser beam type, or some other type. Of those recording apparatuses, the recording apparatus of ink jet type (hereinafter may be referred to also as an ink jet recording apparatus) performs recording by discharging ink from recording means (hereinafter may be referred to also as a recording head) to a recording medium, and this recording means has such excellent advantages as to make it easier to record in higher precision at higher speed with a lesser amount of noise, and at lower cost than the other types.

Also, in recent years, there has been an increasing need for a recording apparatus capable of outputting highly precise color images, and there have been developed, too, various color ink jet recording apparatuses capable of recording color images by discharging ink of plural colors.

In such an ink jet recording apparatus, a recording head having a plurality of recording elements integrally arranged is used for improving a recording speed. As for that recording head, it is generally practiced that a plurality of integrally formed ink discharge ports and liquid flow paths are used for the ink discharge portion. Also, for color recording, a plurality of the aforesaid recording heads are provided.

FIG. 1 is a view that shows the structure of the printing unit used for printing by the aforesaid recording head on the surface of a recording sheet. In FIG. 1, each structure designated by a reference numeral 101 is an ink cartridge. Each of them is formed by an ink tank containing one of four colors, black, cyan, magenta, and yellow, respectively, as well as by a recording head 102. For the recording head 102, the discharge port array is formed with a plurality of discharge ports. FIG. 2 is a view that schematically shows the state of the plurality of discharge ports arranged for the recording head 102, observed in the direction indicated by z in FIG. 1. In FIG. 2, a reference numeral 201 designates a plurality of discharge ports arranged on the recording head 102.

Also, in FIG. 1, a reference numeral 103 designates a sheet conveying roller that conveys the recording sheet P in the direction y, as required, by rotating in the direction indicated by an arrow in FIG. 1, while pressing the recording sheet P in cooperation with an auxiliary roller 104. Also, a reference numeral 105 designates a sheet feed roller for feeding a recording sheet, while pressing the recording sheet P in the same manner as the rollers 103 and 104. A reference numeral 106 designates a carriage to support the four ink cartridges, and allows printing by enabling them to travel.

The carriage is arranged to be on standby in the home position h indicated by dotted line in FIG. 1 when printing is at rest or operating the recovery of the recording head or the like.

The carriage 106 in the home position before the initiation of printing is caused to travel in the direction indicated by an arrow X in FIG. 1 when the command to begin printing is received, while discharging ink from a plurality of discharge ports 201 formed on the discharge port surface of the recording head 102 for recording in accordance with recording data. Then, when printing of data is completed up to the edge portion of the recording sheet, the carriage returns to the original home position and again performs printing while traveling in the direction X.

When pictorial images are printed, various elements, such as coloring, gradation, and evenness, are required. Particularly, for evenness, slight variations of nozzles per unit that may take place in the manufacturing process of a recording head tend to exert influence on the ink discharge amount of each nozzle and the discharging direction thereof in the printing operation, and it is known that the degradation of image quality is brought about by this influence eventually as density unevenness of printed image.

Here, the specific example thereof will be described in conjunction with FIGS. 3 and 4. At (1) in FIG. 3, a reference numeral 31 designates the recording head schematically. The nozzle array provided for the recording head 31 is formed by eight nozzles 32. Also in FIG. 3, a reference numeral 33 designates an ink droplet discharged from the nozzle 32 (hereinafter, may be referred to also as "ink droplet" or simply as "ink"). Also, (2) in FIG. 3 shows one example of the image that is formed by ink discharged periodically from the nozzle array of the recording head 31. (2) in FIG. 3 represents the example, in which recording is performed with eight dots per each nozzle, while the recording head is being moved. (3) in FIG. 3 is a graph that shows the optical density of the image represented at (2) in FIG. 3. At (3) in FIG. 3, the axis of abscissa corresponds to the density.

Ideally, each ink droplet discharge from the recording head 31 should be in the same amount and direction as shown at (1) in FIG. 3. If discharge is made ideally like this, dots of the same size are impacted on the surface of recording sheet as shown at (2) in FIG. 3. As a result, then, it becomes possible to obtain an image having no unevenness in overall density as shown at (3) in FIG. 3.

However, as described earlier, there are actually variations in individual nozzles, and if ink is discharged for printing without compensation, density unevenness is created due to the variations of the size of each ink droplet discharged from each nozzle and the direction thereof.

FIG. 4 is a view that schematically illustrates density unevenness when there are variations in a plurality of nozzles of the recording head. (1) to (3) in FIG. 3 correspond to (1) to (3) in FIG. 4, respectively. In comparison with each other, it is possible to compare each condition of recording when it is ideally performed and when it is performed with the nozzles having individual variations.

(1) in FIG. 4 shows the recording head, and the state where there are variations in the size and direction of each of the ink droplets discharged from the recording heads. As shown at (1) in FIG. 4, when the size and direction of each ink droplet discharged for each nozzle are varied, each of them is impacted on the surface of the recording sheet as shown at (2) in FIG. 4. According to (2) in FIG. 4, there exist periodically the blank portion on the recording sheet where the area factor is not satisfied 100% with respect to the head main scanning direction, or on the contrary, dots are overlapped more than necessary or as shown in the central part of (2) in FIG. 4, a white streak occurs. The gathering of dots thus impacted presents the density distribution as shown at (3) in FIG. 4 with respect to the direction of the nozzle array. As a result, these phenomena are sensed as density unevenness as far as the normal human eyesight is concerned. Also, there may be some cases where streaks become conspicuous due to the variations that may take place in the amount of sheet feeding.

To cope with the density unevenness described above, a method for reducing density unevenness is disclosed in the specification of Japanese Patent Application Laid-Open No. 06-143618. With reference to FIG. 5, such method will be described briefly hereunder.

The recording operation shown in FIG. 5 is completed by enabling the recording head 31 to scan three times in the recording area shown at (2) in FIG. 3 and (2) in FIG. 4, and at (1) in FIG. 5 the relative positions of the recording head 31 at the first, second, and third scans are shown. In this recording operation, the recording head 31 and the recording sheet are relatively moved in the sub-scanning direction (at (1) in FIG. 5, the nozzle arrangement direction of the recording head) per scanning of the recording head. Also, the amount of the relative movement is the one corresponding to half of eight nozzles provided for the recording head 31.

According to the recording operation shown in FIG. 5, the recording head 31 performs the main scans three times in the printing area shown at (2) in FIG. 3 and (2) in FIG. 4, but a half of the printing area, that is, an area corresponding to four nozzles, is completed by the scanning of the recording head two times (hereinafter referred to as a two-pass). In this case, the eight nozzles of the recording head are divided into two groups, that is, the upper side four nozzles and the lower side four nozzles. Then, the dots printed by one nozzle per main scan are those which are regular image data thinned approximately by half in accordance with a certain designated image data arrangement. Then, dots are covered in the remaining half of the image data when the second main scanning is performed in order to complete printing in the unit area of four pixels. The recording method described above is called a multi-pass recording method hereunder. In this respect, the recording method shown in FIG. 5 may be called a two-pass recording method, because a designated area is completed by a two-time scanning.

With a recording method of the kind, even if the same recording head as shown at (1) in FIG. 4 is used, the influence of each nozzle per se that may be exerted on the printing image is reduced by half. The printed image becomes as shown at (2) in FIG. 5, and such black streaks and white streaks as shown at (2) in FIG. 4 are no longer too conspicuous. Therefore, the density unevenness becomes less conspicuous as shown at (3) in FIG. 5 as compared with the case shown at (3) in FIG. 4. When a recording of the kind is performed, the first main scan and the second main scan are divided in a form of complementing each other in accordance with a certain designated arrangement of image data. Usually, here, it is most common that this image data arrangement is used in the form of checkered flag pattern having every other pixel arranged vertically and horizontally in it as shown in FIGS. 6A to 6C. Consequently, in the printing area per unit (here, in a unit of four pixels), recording is completed with the first main scan that records the a checkered flag pattern, and the second main scan that records the reverse checkered flag pattern (the reverse pattern of the first scan). Each of FIGS. 6A to 6C illustrates the way in which a designated area is recorded by use of the checkered flag- and reverse checkered flag-thinning patterns, respectively. Here, in FIGS. 6A to 6C, reference numerals 31*a*, 31*b*, and 31*c* designate the relative positions of the recording head 31 in the first, second, and third scans, respectively.

In FIGS. 6A to 6C, at first in the first main scan, the checkered flag-thinning pattern is recorded by use of the lower four nozzles (FIG. 6A). Then, in the second main scan, the recording sheet is fed for a portion of four pixels (½ of the head length), and the reverse checkered flag-thinning pattern is recorded (FIG. 6B). Further, in the third main scan, the recording sheet is again fed for a portion of four pixels (½ of the head length) and the checkered flag-thinning pattern is again recorded (FIG. 6C). In this way, the sheet feeding per four-pixel unit and the checkered flag and reverse checkered flag patterns are recorded alternately to complete the recording area of four-pixel unit per main scan.

As described above, with the completion of the image in the same area by different nozzles one after another, it is made possible to obtain a high quality image having no density unevenness.

Also, there is disclosed in the specification of Japanese Patent Laid-Open Application No. 06-135014 to obtain a high quality image by preventing the occurrence of bleeding on the adjacent boundaries of a black image and a color image. To describe such art briefly, when a black image printed in black ink and a color image printed in color ink are adjacent to each other, a designated discharge portion is used among the discharge group for black ink discharge so that scanning for the formation of a black image (scanning in the direction X described above) is not made to scan continuously for recording a color image (scanning in the direction X as described above). In this way, bleeding on the adjacent boundaries of a black image and a color image is prevented so as to attain recording of a high quality image.

However, there is no disclosure in the specification of the aforesaid Japanese Patent Application Laid-Open No. 06-135014 as to the multi-pass recording or recording provided with the setting of two or more kinds of amounts for conveying a recording sheet.

With attention to the bleeding between colors in the aforesaid multi-pass recording method, studies have been made. It is found that when the multi-pass recording method is adopted, the bleeding has characteristics different from those encountered in the case where an image is completed by one-time scanning of a recording head.

Also, in addition to the bleeding, it is found that there is difference between the one-pass recording method and the multi-pass recording method in the phenomenon that the recorded portion becomes whitish due to the ink droplets pushing each other on a recording medium when ink of plural colors is impacted on the surface of the recording medium. The difference in such phenomenon is caused by the permeating and fixing conditions of ink on a recording medium, which are different between them, because the multi-pass recording method has a smaller number of dots to be recorded per unit time on a designated area, besides the effect of the multi-pass recording method for the prevention of density unevenness.

Also, as regards the recording, which is provided with the setting of two or more kinds of conveying amounts of a recording medium, it is observed that if each of the image areas is completed by discharging ink from at least two kinds or sets of discharge port arrays using the multi-pass recording method, color unevenness occurs between areas where time difference takes place in the completion of images within the overlapped image area that contains the first image area to be completed by the first discharge port array and the second image area to be completed by the second discharge port array. Here, in the first image area completed by the first discharge port array, the permeation and ink fixing on the recording medium are caused to change as the time elapses. Therefore, if ink is discharged from the second discharge port array to overlap it or place it adjacent to the first image area the conditions of which are being changed as the time elapses, the permeation and fixing conditions of the overlapped or adjacent ink on the recording medium are made different according to the time required for completing such change of states. This is the phenomenon that may cause the occurrence of such color unevenness as described above.

SUMMARY OF THE INVENTION

It is an object of the present invention to provide an ink jet recording apparatus capable of reducing the bleeding between colors created characteristically by the multi-pass recording method, and also, capable of preventing color unevenness from being created by a recording method provided with two or more kinds of conveying amounts of a recording medium for recording high quality images.

To solve the problems discussed above, an ink jet recording apparatus of the present invention records by discharging ink while the recording head thereof executes the main scans relatively to a recording medium, and provided with at least two kinds of discharge port arrays having a plurality of ink discharge ports arranged in the direction different from the aforesaid main scanning direction, and also, provided with a recording method in which the number of recording scans in the main scanning direction is m (m: a positive integer) to complete an image by a first discharge port array, and the number of recording scans in the main scanning direction is n (n: a positive integer) to complete the image by a second discharge port array, and at least two kinds of one-time conveying amounts for conveying the recording medium in the sub-scanning direction per main scan. Then, with respect to the first discharge port array, the second discharge port array makes the position of the leading end portion of the discharge ports used from the side of the sheet feeding direction for feeding the recording medium equal to the length of the continuously conveying amount of (m+a) (a: a positive integer) times using at least the aforesaid two kinds of conveying amounts.

Also, an ink jet recording apparatus of the present invention records by discharging ink while the recording head thereof executes the main scans relatively to a recording medium, and provided with at least two kinds of discharge port arrays having a plurality of ink discharge ports arranged in the direction different from the aforesaid main scanning direction, and also, provided with a recording method in which the number of recording scans in the main scanning direction is m (m: a positive integer) to complete an image by a first discharge port array, and the number of recording scans in the main scanning direction is n (n: a positive integer) to complete the image by a second discharge port array, and at least two kinds of one-time conveying amounts for conveying the recording medium in the sub-scanning direction per main scan. Then, with respect to the first discharge port array, the second discharge port array makes the position of the leading end portion of the discharge ports used from the side of sheet expelling direction for expelling the recording medium equal to the length of the continuously conveying amount of (m+a) (a: a positive integer) times using at least the aforesaid two kinds of conveying amounts.

Also, an ink jet recording apparatus of the present invention records by discharging ink while the recording head thereof executes the main scans relatively to a recording medium, and provided with at least two kinds of discharge port arrays having a plurality of ink discharge ports arranged in the direction different from the aforesaid main scanning direction, and also, provided with a recording method in which the number of recording scans in the main scanning direction is m (m: a positive integer) to complete an image by a first discharge port array, and the number of recording scans in the main scanning direction is n (n: a positive integer) to complete the image by a second discharge port array, and at least two kinds of one-time conveying amounts for conveying the recording medium in the sub-scanning direction per main scan. Then, with respect to the first discharge port array, the second discharge port array makes the position of the leading end portion of the discharge ports used from the side of sheet feeding direction for feeding the recording medium larger than the length of the continuously conveying amount of (m+a) (a: a positive integer) times and smaller than the length of the continuously conveying amount of (m+a+1) using at least the aforesaid two kinds of conveying amounts.

Also, an ink jet recording apparatus of the present invention records by discharging ink while the recording head thereof executes the main scans relatively to a recording medium, and provided with at least two kinds of discharge port arrays having a plurality of ink discharge ports arranged in the direction different from the aforesaid main scanning direction, and also, provided with a recording method in which the number of recording scans in the main scanning direction is m (m: a positive integer) to complete an image by a first discharge port array, and the number of recording scans in the main scanning direction is n (n: a positive integer) to complete the image by a second discharge port array, and at least two kinds of one-time conveying amounts for conveying the recording medium in the sub-scanning direction per main scan. Then, with respect to the first discharge port array, the second discharge port array makes the position of the leading end portion of the discharge ports used from the side of sheet expelling direction for expelling the recording medium larger than the length of the continuously conveying amount of (m+a) (a: a positive integer) times and smaller than the length of the continuously conveying amount of (m+a+1) using at least the aforesaid two kinds of conveying amounts.

Also, in accordance with the present invention, at least one of the positions of the discharge ports used for one main scan to complete an image by the aforesaid first discharge port array and the discharge ports used for one main scan to complete the image by the aforesaid second discharge port array is made different according to the combination of the continuously conveying amount of the aforesaid (m+a) (a: a positive integer) times including the next conveying amount.

DETAILED DESCRIPTION OF THE PREFERRED EMBODIMENTS

Hereinafter, with reference to the accompanying drawings, the detailed description will be made of the embodiments in accordance with the present invention.

Figure 1:
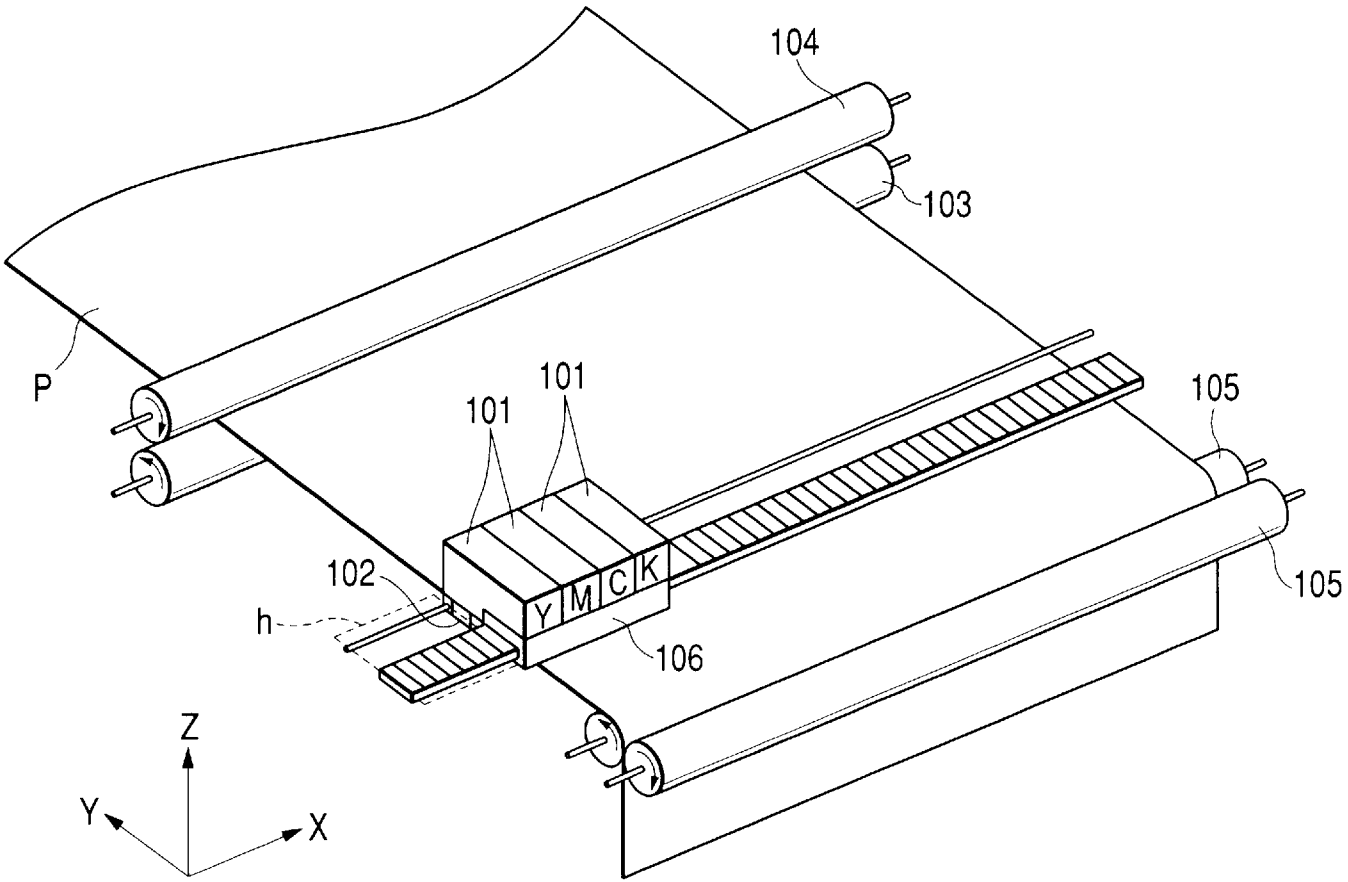
FIG. 1 is a view that schematically illustrates an ink jet recording apparatus to which the present invention is applicable.
Figure 2:
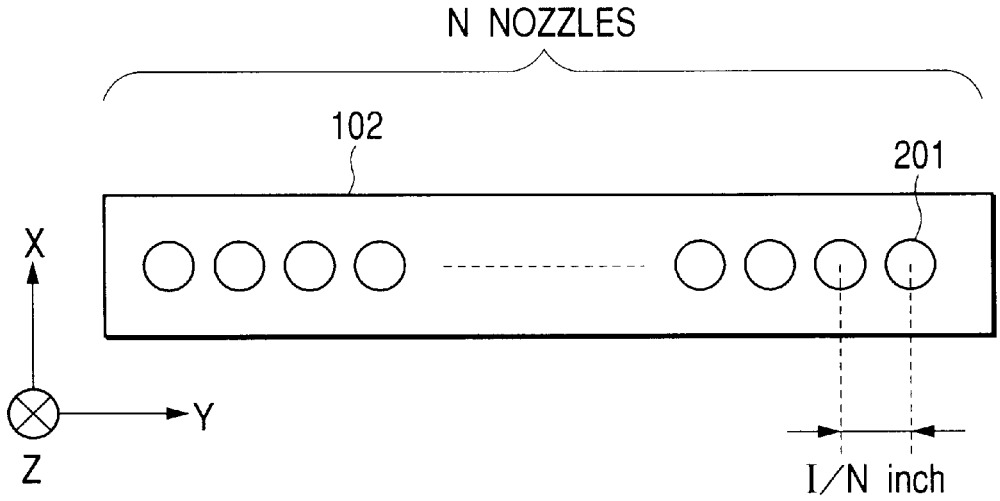
FIG. 2 is a view that schematically shows the nozzle arrangement of an ink jet recording head.
Figure 7:
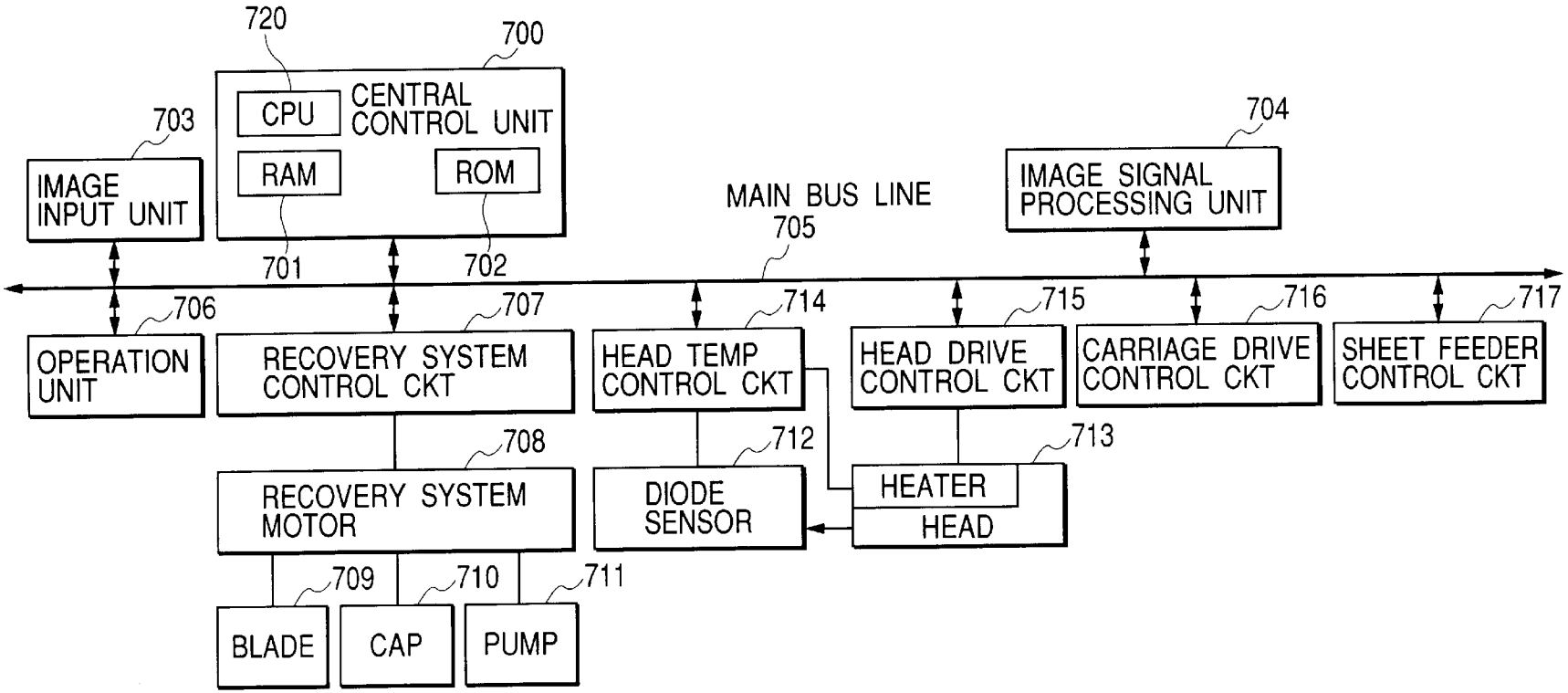
FIG. 7 is a block diagram which shows the control structure of the ink jet recording apparatus to which the present invention is applicable.

FIG. 7 is a block diagram which shows the control structure of an ink jet recording apparatus in accordance with one embodiment of the present invention. Here, the mechanical structure of the ink jet recording apparatus is the same as the structure shown in FIG. 1, and the recording apparatus is of the serial type where the recording head scans in the main scanning direction for recording.

In FIG. 7, the structure is roughly divided into soft system processing means, such as an image input unit 703 that has access to the main bus line 705; an image signal processing unit 704 therefor; and a central control unit 700, and hard processing means, such as an operation unit 706; a recovery system control circuit 707; an ink jet head temperature control circuit 714; a head driving control circuit 715; a driving control circuit 716 for carriage in the main scanning direction; and a control circuit 717 for sheet conveyance in the sub-scanning direction.

The central control unit 700 shown in FIG. 7 is usually provided with a ROM 701 and a random memory (RAM) 702. Then, by the control of a CPU 720, this unit provides appropriate recording conditions for driving the recording head 713 in accordance with input information. Also, in the RAM 702, a program is stored in advance to execute the head recovery timing chart, and such recovery condition as preliminary discharge, is given to the recovery system control circuit 707, the recording head, the warming heater, and the like as required. A recovery system motor 708 drives the cleaning blade 709 to be in contact with or away from the aforesaid recording head 713, a cap 710, and a suction pump 911.

The recording head 713 is a recording head (hereinafter, may be referred to as an ink jet head) of ink jet type that discharges ink. In accordance with the present embodiment, the recording head 713 is provided with an electrothermal converting element as discharge means for discharging ink, and then, by the application of thermal energy, a bubble is generated in ink to discharge ink from the discharge port of the recording head 713, which is the recording head of the so-called bubble jet type. Also, for the present embodiment, a heater is adopted as the electrothermal converting element.

The head driving control circuit 715 executes control in accordance with the driving condition of the ink discharge electrothermal converting element of the recording head 713 to enable the recording head 713 to perform the usual preliminary discharge and ink discharge for recording.

On the other hand, the structure is arranged to install the warming heater on the base plate of the recording head 713 having the ink discharge electrothermal converting element provided therefor so that the temperature of ink in the recording head can be adjusted by heating to set it at a desired temperature. Also, a diode sensor 712 is installed likewise on the base plate to measure the temperature of ink in the recording head essentially. In this respect, the diode sensor 712 may be installed outside, not necessarily on the base plate or in the vicinity of the circumference of the recording head.

Also, in accordance with the present invention, the recording operation is to form images on a recording medium by repeating the recording operation to record, while the recording head scans in the main scanning direction, as well as the operation to convey (sub-scan) the recording medium in the sub-scanning direction. Then, it is structured to make the execution thereof controllable by the control of the aforesaid central control unit 700.

Also, the recording head (hereinafter, may be referred to as recording means) used for each of the embodiments to be described below is provided with the electrothermal converting element that applies thermal energy to ink. It is structured then to generate bubble in ink by means of thermal energy for discharging ink from the discharge port. In this respect, the present invention is not necessarily limited to this structure of the recording head, but it is applicable to the method in which ink is discharged by use of a piezoelectric element.

Hereunder, the description will be made of several embodiments of the present invention on the basis of the apparatus structured as described above.

(First Embodiment)

Figure 8:
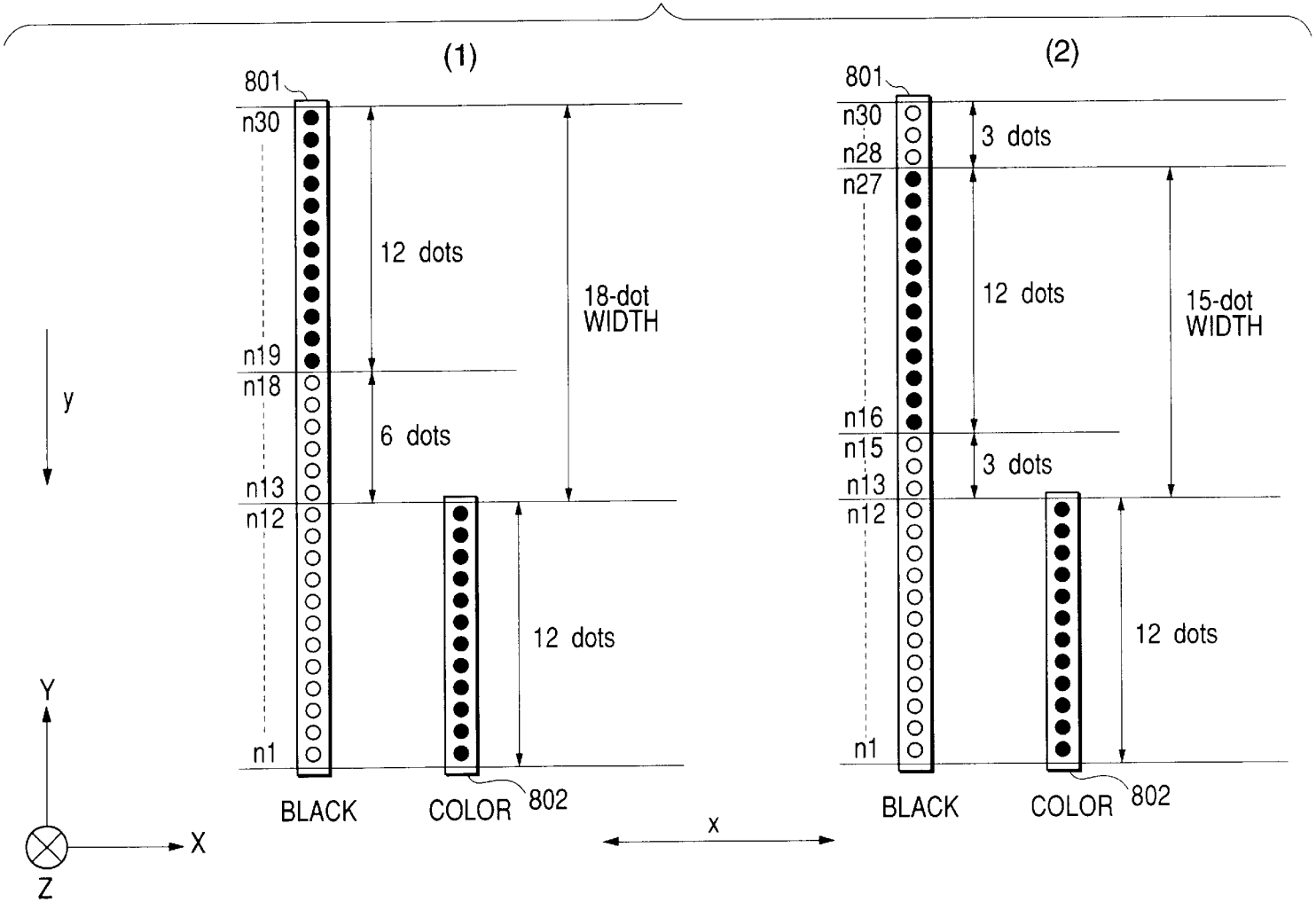
FIG. 8 is a structural view of the recording head to which the present invention is applicable.

FIG. 8 is a view that schematically shows a recording head in accordance with a first embodiment of the present invention.

In FIG. 8, a first recording head 801 that discharges black ink is provided with discharge port number n=30 discharge ports (30 nozzles) at a density of 600 dpi (the discharge port number N per inch=600). For the recording method of the first embodiment of the present invention, the discharge ports used for ink discharge for recording, among the discharge ports n1 to n30 provided for the first recording head 801, are defined to be 12 ports of n19 to n30 indicated at (1) in FIG. 8 or 12 ports of n16 to n27 indicated at (2) in FIG. 8. Here, in FIG. 8, the black circles shown inside the recording head correspond to the discharge ports used for recording, and the white circles correspond to those not used when recording is performed.

Also, a second recording head 802 shown in FIG. 8 that discharges color ink is provided with 12 discharge ports (12 nozzles) (discharge port number n=12) at a discharge port number N per inch=of 600 (600 dpi). For the recording method of the first embodiment of the present invention, all the 12 discharge ports, n1 to n12, provided for the recording head 802 are used for recording.

In FIG. 8, the positional relations of the discharge ports (nozzles) of the recording head 801 and the recording head 802 are such that in the sub-scanning direction indicated by an arrow y, they are arranged coincidently in the positions of the same discharge port numbers, and that in the main scanning direction indicated by an arrow x, they are arranged at designated intervals. In this respect, the arrow y indicates the direction indicated by an arrow Y shown at the lower left in FIG. 8 (the same arrow mark as the one that indicates the direction in FIG. 1). Also, the arrow x indicates the direction indicated by an arrow X at the lower left in FIG. 8.

Here, in FIG. 8, as well as in the embodiment to be described below, only one recording head is shown for color ink use, but a plurality of color ink heads may be arranged in the direction indicated by the arrow x corresponding to the numbers of color inks used for recording. The present invention is applicable to an ink jet recording apparatus that records by discharging four colors of ink, black, yellow, magenta, and cyan. For a structure of the kind, three units of the second recording head 802 are arranged in the direction x in FIG. 8. Also, if ink of different densities should be used for each color, it may be possible to provide a plurality of recording heads in accordance with the structure required for use of such plural ink materials having different densities.

Figure 9:
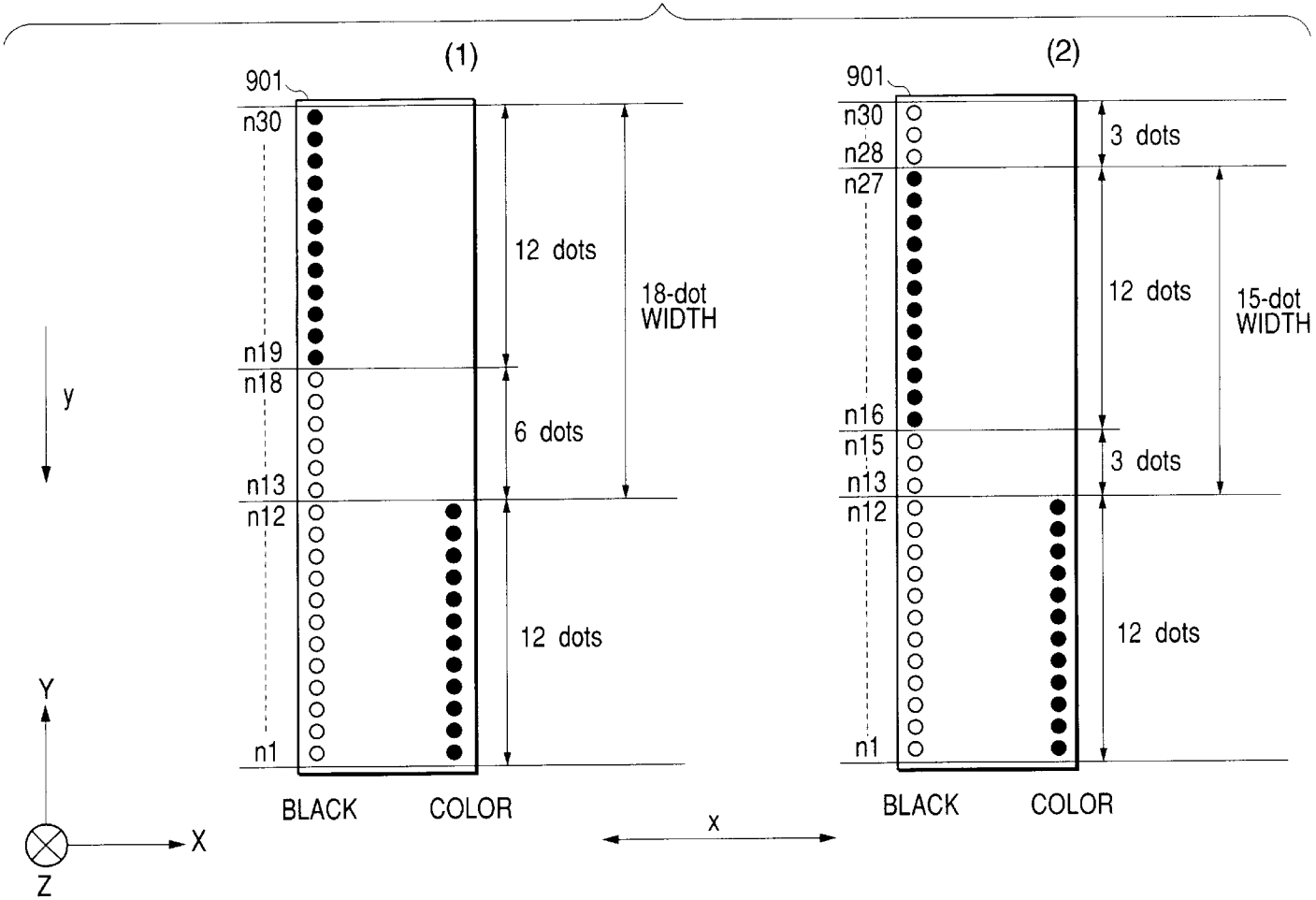
FIG. 9 is a structural view of the recording head to which the present invention is applicable.
Figure 10:
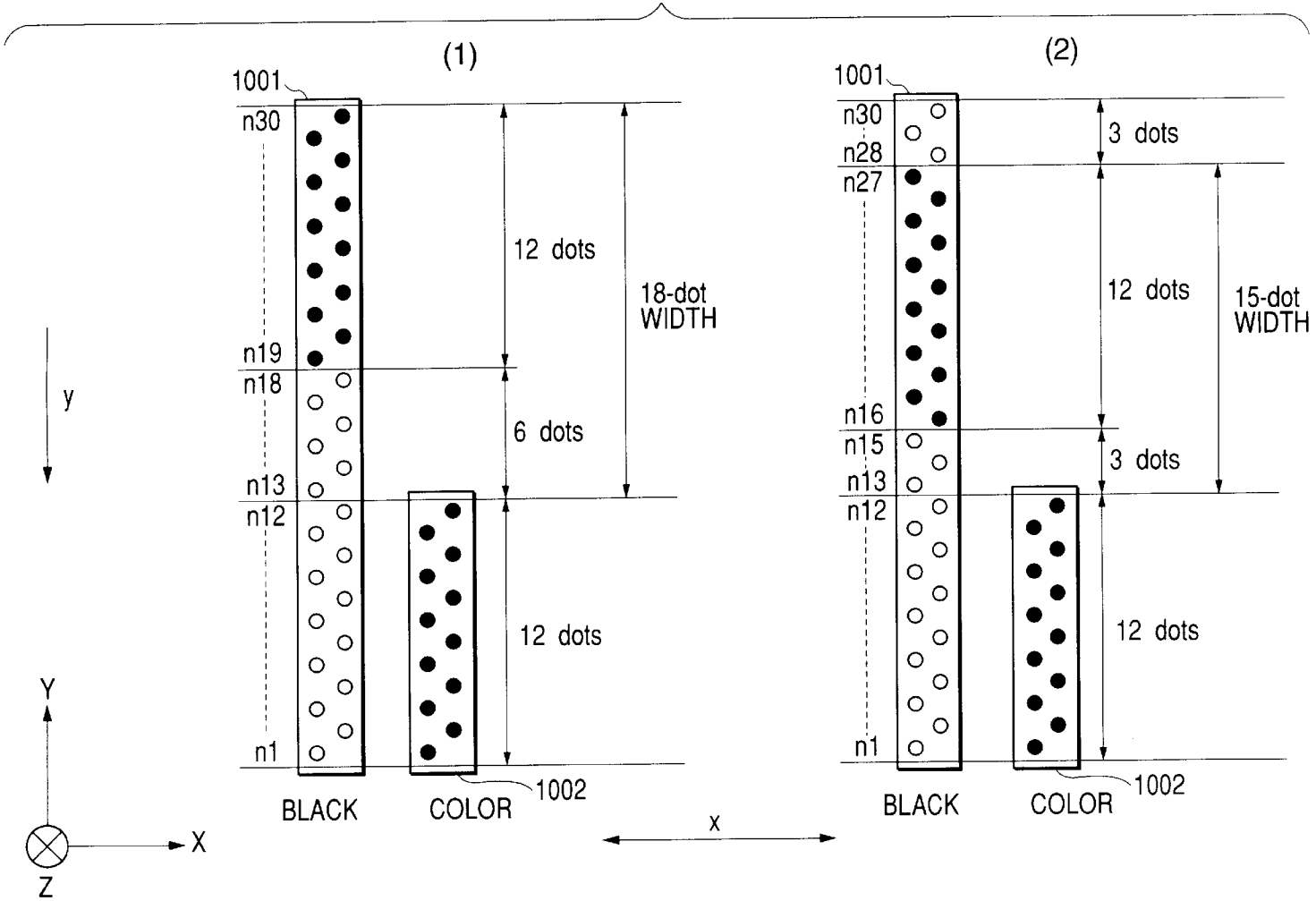
FIG. 10 is a structural view of the recording head to which the present invention is applicable.
Figure 11:
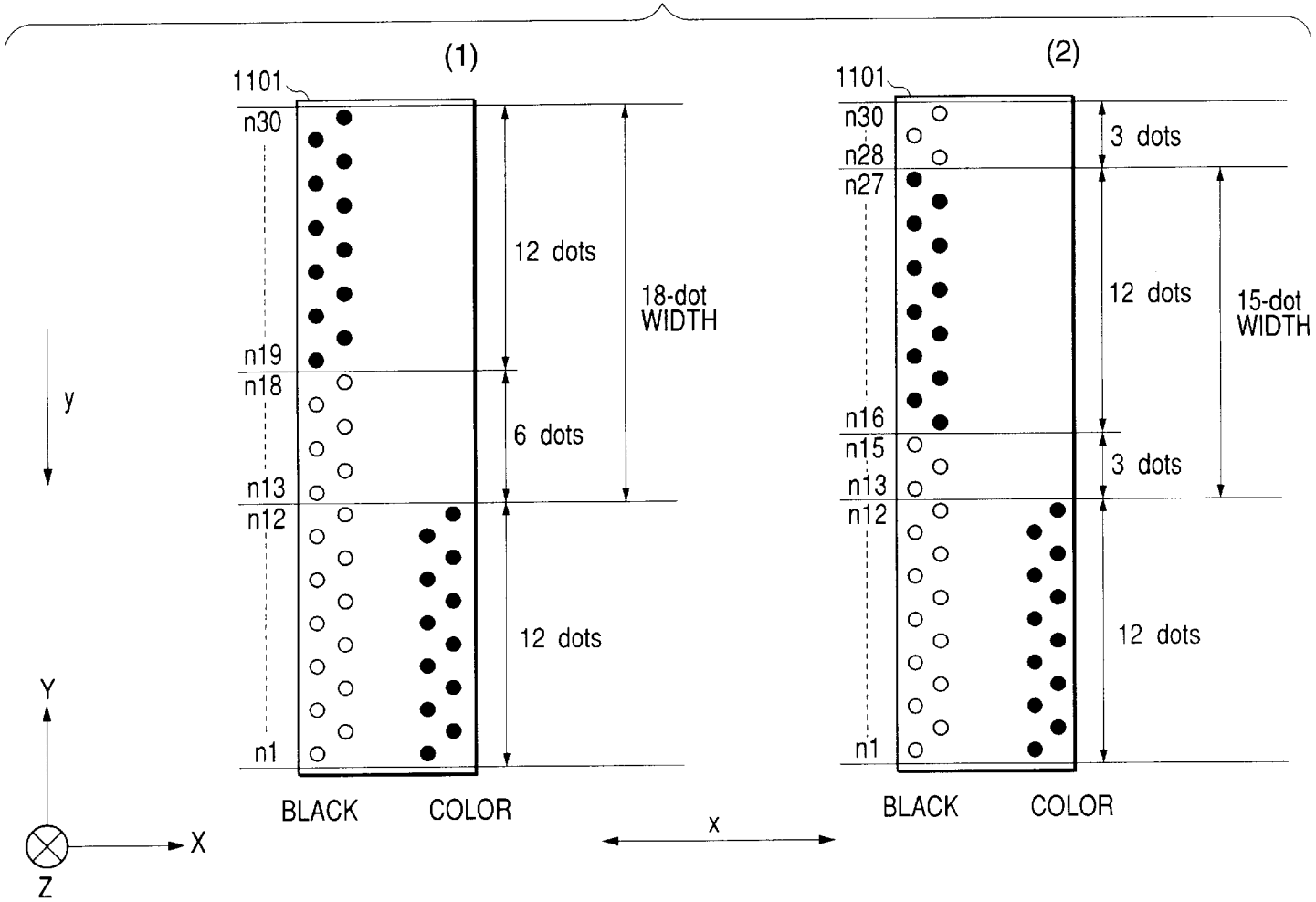
FIG. 11 is a structural view of the recording head to which the present invention is applicable.

In this respect, the recording head 801 that discharges black ink and the recording head 802 that discharges color ink may be structured together as one recording head 901 shown in FIG. 9. Also, as shown in FIG. 10 or FIG. 11, the arrangement of discharge ports may be in plural lines, not in one line. The recording heads 1001 and 1002 in FIG. 10, and the recording head 1101 in FIG. 11 are provided with the discharge ports in two lines, and the two lines are formed each by the discharge port array (hereinafter, may be referred to as a discharge port group) corresponding to even numbered discharge ports, and odd numbered ones, respectively. Then, the structure is formed so that the even numbered discharge ports and odd numbered ones are arranged in the checkered flag formation. Here, for the structure shown in FIG. 10, the recording head 1001 for black ink use and the recording head 1002 for color ink use are arranged separately to form a separable structure. Also, in FIG. 11, the recording head 1101 is structured to provide the discharge port array for black ink use and the discharge port array for color ink use integrally.

In this respect, the contents represented in FIG. 9 to FIG. 11 correspond to those shown in FIG. 8. Then, as shown in FIG. 8, the black circles inside the recording head indicate the discharge ports used for recording, and the white circles indicate the ones not used when recording is performed.

Also, driving signals, which are used for the recording heads having the discharge port arrays formed as shown in FIG. 10 and FIG. 11, are supplied to the preceding discharge port group at a timing faster by d/v (second) than the following discharge port group. Here, d (inch) designates the distance between the odd numbered discharge port group and the even numbered discharge port group, and v (inch/second) designates the scanning speed of the recording head in the main scanning direction.

In this respect, for the recording heads structured as described above, the first recording head 801 in the structure shown in FIG. 8 is called a first discharge port array, and the second recording head 802, a second discharge port array, and both can be called recording means. In the structure shown in FIG. 9, the discharge port array for black ink use is called a first discharge port array, and the discharge port array for color ink use, a second discharge port array, and then, the recording head 901 can be called recording means. Also, in FIG. 10, the recording head 1001 for black ink use is called a first discharge port array, and the recording head 1002, a second discharge port array, and then, these can be called recording means, because the structure is so arranged that recording is made executable by such means that includes heads 1001 and 1002. Also, in the structure shown in FIG. 11, the recording head 1101 is called recording means, and the discharge port array for black ink use can be called a first discharge port array, and the discharge port array for color ink use, a second discharge port array.

Also, the Ka value of the used black ink is 1.0 ($ml \cdot m^{-2} \cdot msec^{-1/2}$) by the Bristow tester, and the Ka value of the used color ink is 7.0 ($ml \cdot m^{2} \cdot msec^{-1/2}$) by the Bristow tester. Thus, the black ink has the property of lower permeability than the color ink, and the Ka value of black ink is smaller.

Figure 12:
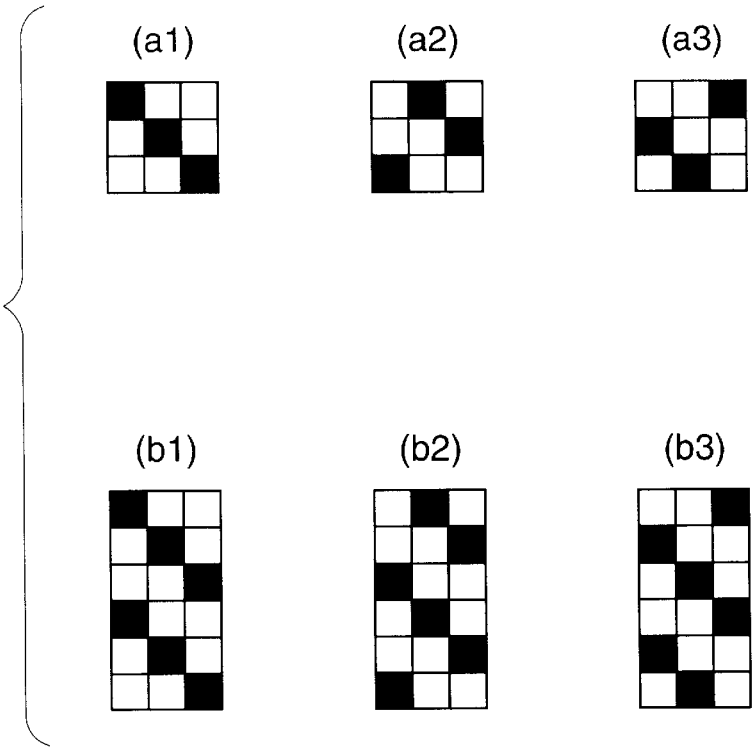
FIG. 12 is a view that schematically illustrates thinning patterns embodying the present invention.
Figure 13:
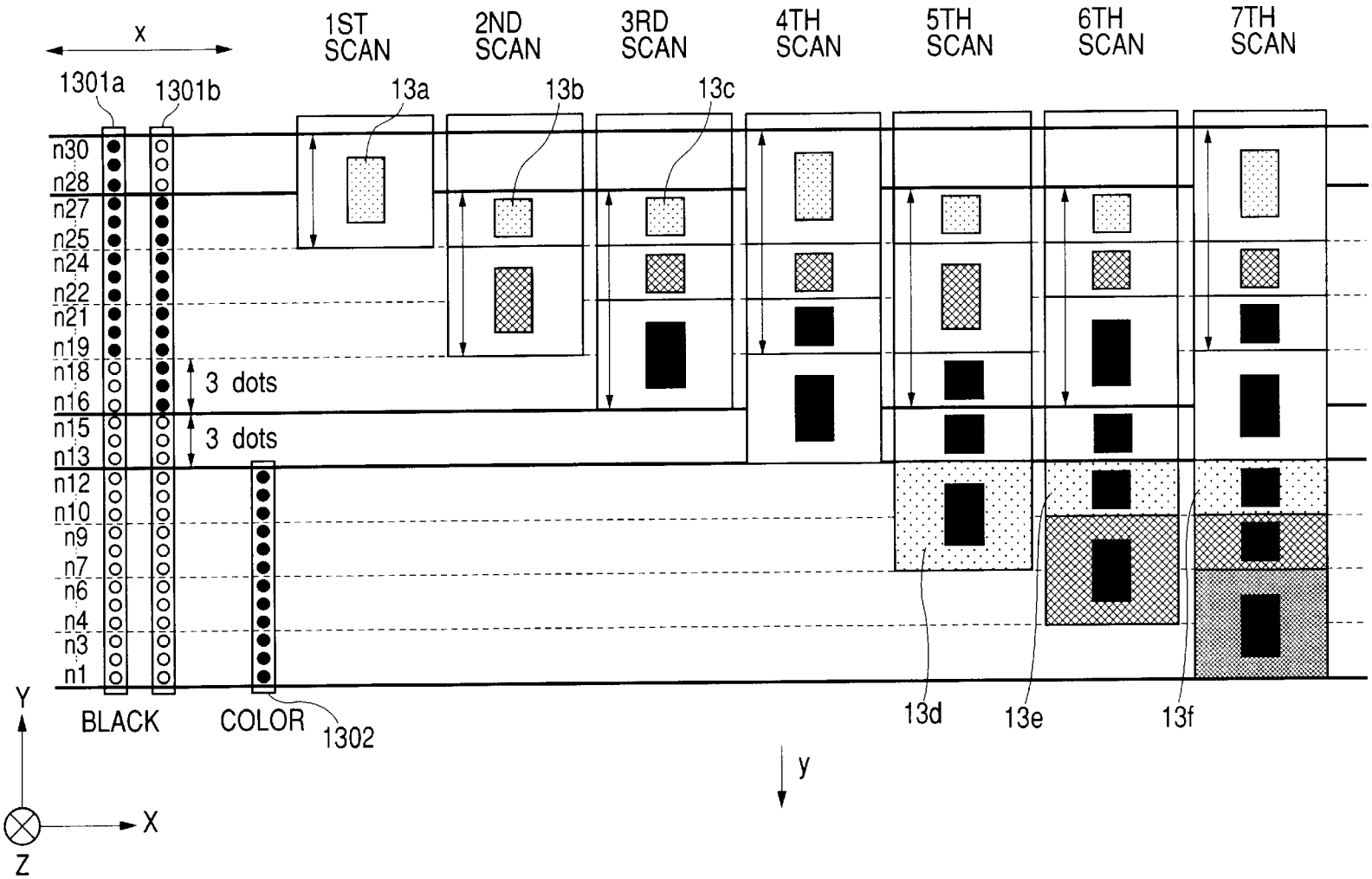
FIG. 13 is a view that illustrates a recording method in accordance with a first embodiment of the present invention.

With reference to FIG. 12 and FIG. 13, the description will be made of a recording method in accordance with the first embodiment.

(a1) to (b3) in FIG. 12 are views that illustrate three kinds of tinning patterns having relations to complement each other when the number of discharge ports is 3 ((a1), (a2), and (a3) in FIG. 12), and the number of discharge ports is 6 ((b1), (b2), and (b3) in FIG. 12). Inside each checkered flag pattern corresponds to the positions of dots to be recorded, respectively. Also, the position solidly painted black is the position where ink is discharged to record the dot. The position, which is not painted, is the position that has been thinned and no dot is recorded. Therefore, using a thinning pattern of such kind, the data that indicate recording dots are masked to make it possible to record dots only on the positions solidly painted black in the pattern, which are not masked.

Now, observing the patterns corresponding to the case where the number of discharge ports is 3 in (a1) to (a3) in FIG. 12, all the areas having 9 dot positions are recorded with dots eventually if patterns (a1), (a2) and (a3) are overlapped. Also, the same is applicable to the case where the number of discharge ports is 6.

Also, FIG. 13 is a view that illustrates the recording operation corresponding to each of the scans of the recording head in the main scanning direction.

In FIG. 13, reference numerals 1301*a* and 1301*b* designate the recording head for black ink use. Black circles inside the recording head indicate the discharge ports used for discharging ink. In FIG. 13, those at 1301*a* correspond to the recording head 801 shown at (1) in FIG. 8. Here, it is indicated that 12 discharge ports n19 to n30 are used for recording. Also, in FIG. 13, those at 1301*b* correspond to the recording head 801 at (2) in FIG. 8. Here, it is indicated that 12 discharge ports n16 to n27 are used for recording. Also, in FIG. 13, those at 1302 correspond to the recording head 802 shown in FIG. 8 for color ink use. In this way, in accordance with the present embodiment, the first recording head for black ink use appropriately executes the recording operation using the discharge ports n19 to n30 shown at 1301*a* and the recording operation using the discharge ports n16 to n27 shown at 1301*b*.

At first, with the first scan shown in FIG. 13, recording is executed using 12 nozzles n19 to n30, which are used for discharging, among 30 nozzles n1 to n30, and enabled to discharge black ink shown at (1) in FIG. 8 corresponding to the black head 1301*a* in FIG. 13. At this juncture, the 6 nozzles from 25th to 30th are used, among 12 nozzles, for discharging to record by use of the thinning pattern shown at (b1) in FIG. 12 for the area 13*a* where the black data exist in FIG. 13.

In continuation, a sheet conveying motor is driven to convey the recording medium in the sub-scanning direction for an amount equivalent to a conveying distance of 6 dots/600 dpi.

In the second scan to follow, recording is executed using 12 nozzles of n16 to n27, which are used for discharging, among 30 nozzles n1 to n30, and enabled to discharge black ink shown at (2) in FIG. 8 corresponding to the black head 1301*b* in FIG. 13. Here, the 6 nozzles from 19th to 24th, among 12 nozzles, are used for discharging to record by use of the thinning pattern shown at (b2) in FIG. 12 for the area 13*a* where the black data exist in FIG. 13. The 3 nozzles from 25th to 27th record by use of the thinning pattern at (a1) in FIG. 12 for the area 13*b* where the black data exist in FIG. 13.

In continuation, the recording medium is conveyed for a portion of 3 dots/600 dpi, and then, in the third scan to follow, recording is executed using 12 nozzles of n16 to n27, which are used for discharging, among 30 nozzles n1 to n30, and enabled to discharge black ink shown at (2) in FIG. 8 corresponding to the black head 1301*b* in FIG. 13. Here, the 6 nozzles from 16th to 21st, among 12 nozzles, are used for discharging to record by use of the thinning pattern shown at (b3) in FIG. 12 for the area 13*a* where the black data exist in FIG. 13. The 3 nozzles from 22nd to 24th record by use of the thinning pattern at (a2) in FIG. 12 for the area 13*b* where the black data exist in FIG. 13. The 3 nozzles from 25th to 27th record by use of the thinning pattern at (a1) in FIG. 12 for the area 13*c* where the black data exist in FIG. 13.

Further, the recording medium is conveyed for a portion of 3 dots/600 dpi, and then, in the fourth scan to follow, recording is executed using 12 nozzles of n19 to n30, which are used for discharging, among the 30 nozzles n1 to n30, and enabled to discharge black ink shown at (1) in FIG. 8 corresponding to the black head 1301*a* in FIG. 13. Here, the 3 nozzles from 19th to 21st, among 12 nozzles, are used for discharging to record by use of the thinning pattern shown at (a3) in FIG. 12 for the area 13*b* where the black data exist in FIG. 13. The 3 nozzles from 22nd to 24th record by use of the thinning patterns at (a2) in FIG. 12 for the area 13*c* where the black data exist in FIG. 13. The 6 nozzles from 25th to 30th record as in the first scan by use of the thinning pattern at (b1) in FIG. 12. Also, in the fourth scan, the area 13*a* where the black data exist in FIG. 13 is not recorded, because this area has been already completed.

Further, the recording medium is conveyed for a portion of 6 dots/600 dpi, and then, in the fifth scan to follow, recording is executed using 12 nozzles of n16 to n27, which are used for discharging, among the 30 nozzles n1 to n30, and enabled to discharge black ink shown at (2) in FIG. 8 corresponding to the black head 1301*b* in FIG. 13. Here, the 3 nozzles from 16th to 18th, among the 12 nozzles, are used for discharging to record by use of the thinning pattern shown at (a3) in FIG. 12 for the area 13*c* where the black data exist in FIG. 13. The 9 nozzles from 19th to 27th record each image area as in the second scan. Also, in this scan, the area 13*b* where the black data exist in FIG. 13 is not recorded, because the area has already been completed in the previous scan. Also, in the fifth scan, the 6 nozzles from 7th to 12th, among 12 nozzles, that discharge color ink shown in FIG. 8 corresponding to the color head in FIG. 13 record by use of the thinning pattern at (b1) in FIG. 12 for the area 13*d* where the color data exist in FIG. 13.

Further, the recording medium is conveyed for a portion of 3 dots/600 dpi, and then, in the sixth scan to follow, each black image area is recorded in the same manner as the third scan, and in the sixth scan, the area 13*c* where the black data exist in FIG. 13 is not recorded, because this area has already been completed in the previous scan. Also, in the sixth scan, the 6 nozzles from 4th to 9th, among the 12 nozzles, corresponding to the color head in FIG. 13 that discharge color ink as shown in FIG. 8 record by use of the thinning pattern at (b2) in FIG. 12 for the area 13*d* where the color data exists in FIG. 13. The 3 nozzles from 10th to 12th record by use of the thinning pattern at (a1) in FIG. 12 for the area 13*e* where the color data exist in FIG. 13.

Further, the recording medium is conveyed for a portion of 3 dots/600 dpi, and then, in the seventh scan to follow, the recording in black is performed in the same manner as the fourth scan. For the color recording, the 6 nozzles from 1st to 6th, among 12 nozzles, corresponding to the color head in FIG. 13 that discharge color ink as shown in FIG. 8 complete by use of the thinning pattern shown at (b3) in FIG. 12 for the area 13*d* where the color data exist in FIG. 13. The 3 nozzles from 7th to 9th record by use of the thinning pattern shown at (a2) in FIG. 12 for the area 13*e* where the color data exist in FIG. 13. The 3 nozzles from 10th to 12th record by use of the thinning pattern shown at (a1) in FIG. 12 for the area 13*f* where the color data exist in FIG. 13.

Further, the recording medium is conveyed for a portion of 6 dots/600 dpi, and then, in the eighth scan (not shown), the recording in black is performed in the same manner as the fifth scan. For the color recording, the 3 nozzles from 1st to 3rd, among 12 nozzles, corresponding to the color head in FIG. 13 that discharge color ink as shown in FIG. 8 complete by use of the thinning pattern shown at (a3) in FIG. 12 for the area 13*e* where the color data exist in FIG. 13. The 3 nozzles from 4th to 6th record by use of the thinning pattern shown at (a2) in FIG. 12 for the area 13*f* where the color data exist in FIG. 13. The 6 nozzles from 7th to 12th record by use of the thinning pattern shown at (b1) in FIG. 12 in the same manner as the fifth scan.

Further, the recording medium is conveyed for a portion of 3 dots/600 dpi, and then, in the ninth scan (not shown), the recording in black is performed in the same manner as the sixth scan. For the color recording, the 3 nozzles from 1st to 3rd, among 12 nozzles, corresponding to the color head in FIG. 13 that discharge color ink as shown in FIG. 8 complete by use of the thinning pattern shown at (a3) in FIG. 12 for the area 13*f* where the color data exist in FIG. 13. The 9 nozzles from 4th to 12th record each image area in the same manner as the sixth scan.

Thereafter, the tenth scan performs recording in the same manner as the seventh scan, the eleventh scan, the same as the eighth scan, and the twelfth scan, the same as ninth scan.

As described above, in the case where the recording scan numbers in the main scanning direction are 3 times each for the first discharge port array that discharges black ink and the second discharge port array that discharges color ink for the completion of an image, and then, the conveying amount of a recording medium in the sub-scanning direction is set to two kinds or modes, namely, 6 dots/600 dpi and 3 dots/600 dpi per main scan, the recording scan number m (whereby to complete an image by the first discharge array that discharges black ink) is 3, so (m+a)=(3+1) 4 times (a is 1) with the amount of continuously conveying a recording medium being two kinds, 18 dots/600 dpi of (6+3+3+6) dots/600 dpi and 15 dots/600 dpi of (3+3+6+3) dots/600 dpi or (3+6+3+3) dots/600 dpi. Here, with respect to the first discharge port array that discharges black ink, the position of the leading end portion of the second discharge port array for discharging color ink, which is used from the side in the sheet feeding direction of the recording medium, is set at a length of 18 dots/600 dpi as shown at (1) in FIG. 8 and 1301*a* in FIG. 13, and set at a length of 15 dots/600 dpi as shown at (2) in FIG. 8 and 1301*b* in FIG. 13. In this way, it becomes possible to prevent bleeding from occurring between colors (between black and color), which is characteristic of the multi-pass recording method. In addition, it becomes possible to make the required time constant at all times for recording in color ink in the image area that has been completed by use of black ink, hence producing an effect of preventing color unevenness in the sub-scanning direction that may take place per recording scan.

In this respect, the thinning patterns are arranged to be as fixed ones for the present embodiment, but it may be possible to use random thinning patterns to prevent synchronization with image data or use different thinning patterns per recording head.

Figure 14:
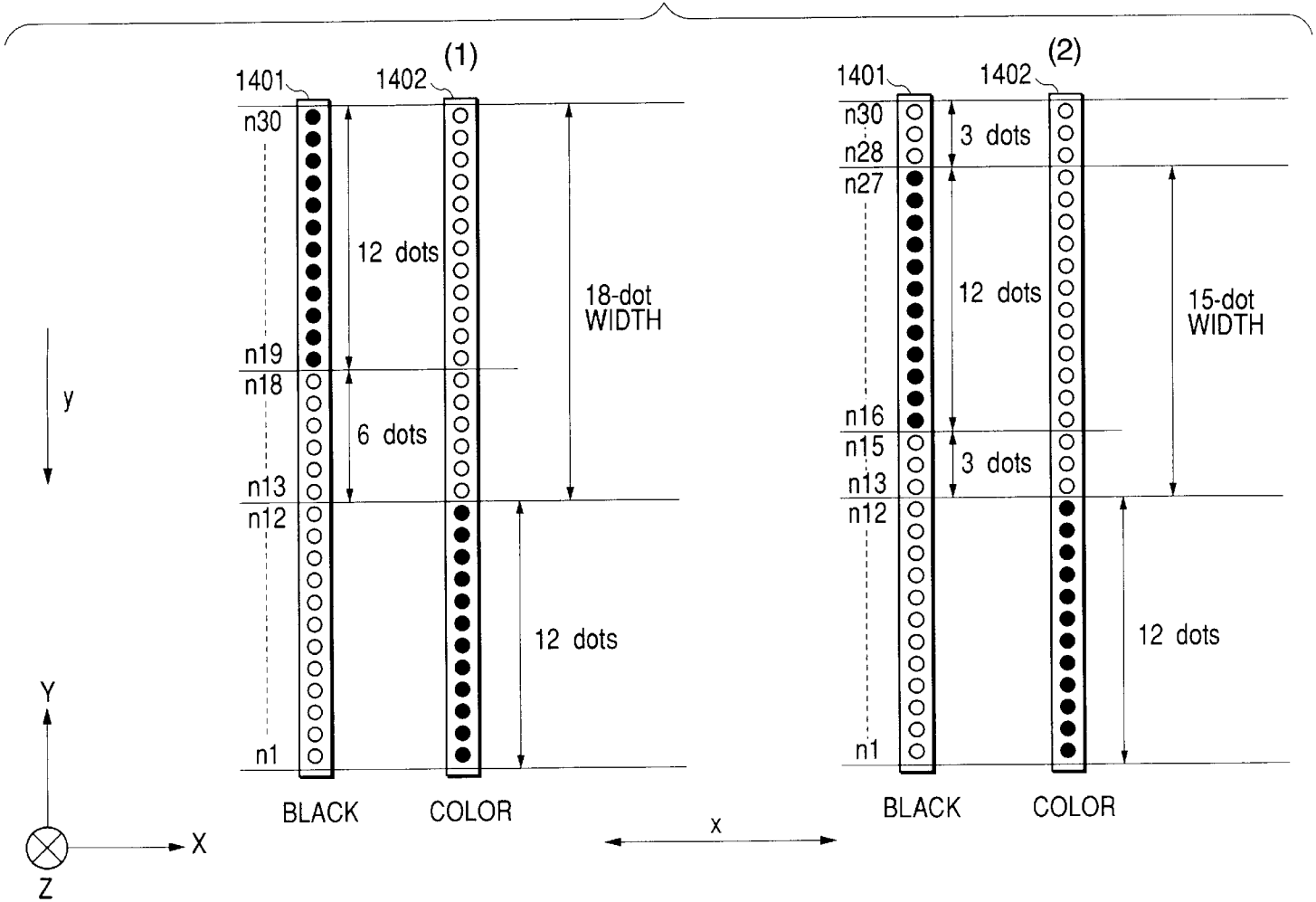
FIG. 14 is a structural view that shows the recording head illustrated in accordance with the first embodiment of the present invention.

Also, for the present embodiment, the discharge port number of the second recording head that discharges color ink is set at 12, and all of them are used, but it may be possible to use a recording head provided with more discharge ports. FIG. 14 is a view that shows recording heads, the second head 1402 for discharging color ink of which has the same number of discharge ports as that of the first recording head 1401. When a second recording head 1402 of this kind is used, it is also made possible to perform the same recording as the example described earlier if the 12 discharge ports of n1 to n12 of the second recording head 1402 are arranged to be used for discharging ink.

Also, the first recording head that discharges black ink is likewise provided with 30 discharge ports, but even when it is provided with more or less discharge ports, it may be possible to position the discharge ports to be used for the multi-pass recording method like the positions of 12 ports used for the present embodiment.

Figure 15:
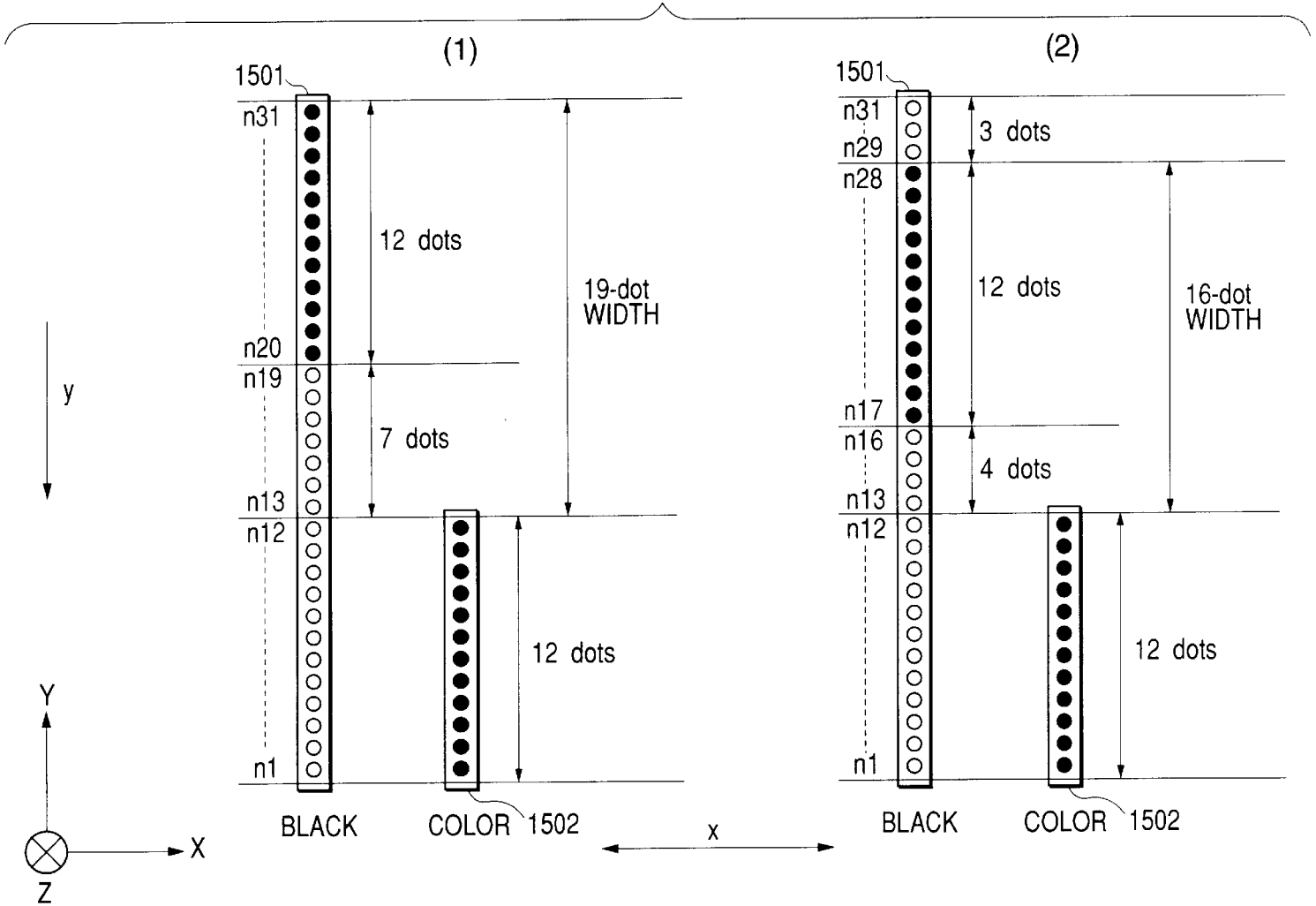
FIG. 15 is a structural view that shows the recording head illustrated in accordance with the first embodiment of the present invention.

Also, with respect to the first discharge port array that discharges black ink for the present embodiment, the position of the leading end portion of the second discharge port array for discharging color ink, which is used from the side in the sheet feeding direction of the recording medium, is set at a length of 18 dots/600 dpi as shown at (1) in FIG. 8 and 1301*a* in FIG. 13, and set at a length of 15 dots/600 dpi as shown at (2) in FIG. 8 and 1301*b* in FIG. 13. However, the length is not necessarily limited thereto. As shown in FIG. 15, if the discharge port number of the first discharge port array that discharges black ink is 31 having the length of 19 dots/600 dpi as shown at (1) in FIG. 15, in which (m+a)=(3+1)=4 times (a is 1) with the amount of continuously conveying a recording medium being larger than 18 dots/600 dpi of (6+3+3+6) dots/600 dpi, and (m+a+1)=(3+1+1)=5 times (a is 1) with the amount of conveying the recording medium being smaller than 21 dots/600 dpi of (6+3+3+6+3) dots/600 dpi, and also, having the length of 16 dots/600 dpi as shown at (2) in FIG. 15, in which (m+a)=(3+1)=4 times (a is 1) with the amount of continuously conveying a recording medium being larger than 15 dots/600 dpi of (3+3+6+3) dots/600 dpi or (3+6+3+3) dots/600 dpi, and (m+a+1)=(3+1+1)=5 times (a is 1) with the amount of conveying the recording medium being smaller than 18 dots/600 dpi of (3+3+6+3+3) dots/600 dpi or 21 dots/600 dpi of (3+6+3+3+6) dots/600 dpi, then the end portion of the image completed by use of the discharge port n20 or n17 of the first recording head that discharges black ink, and the end portion of the image to be recorded by use of the discharge port n12 of the second recording head that discharges color ink are away from the present embodiment by 1 dot/600 dpi. Therefore, it becomes possible to obtain a better effect as to the prevention of bleeding between colors of black and others on the boundary portion of the recording scans.

In accordance with the present embodiment, it is possible to provide an ink jet recording apparatus, which is capable of recording high quality images by preventing bleeding between colors in the multi-pass recording method by the execution of controls described above, as well as in the recording method having two or more kinds of amounts of conveying a recording medium.

(Second Embodiment)

Next, with reference to the accompanying drawings, a second embodiment will be described in accordance with the present invention.

Figure 16:
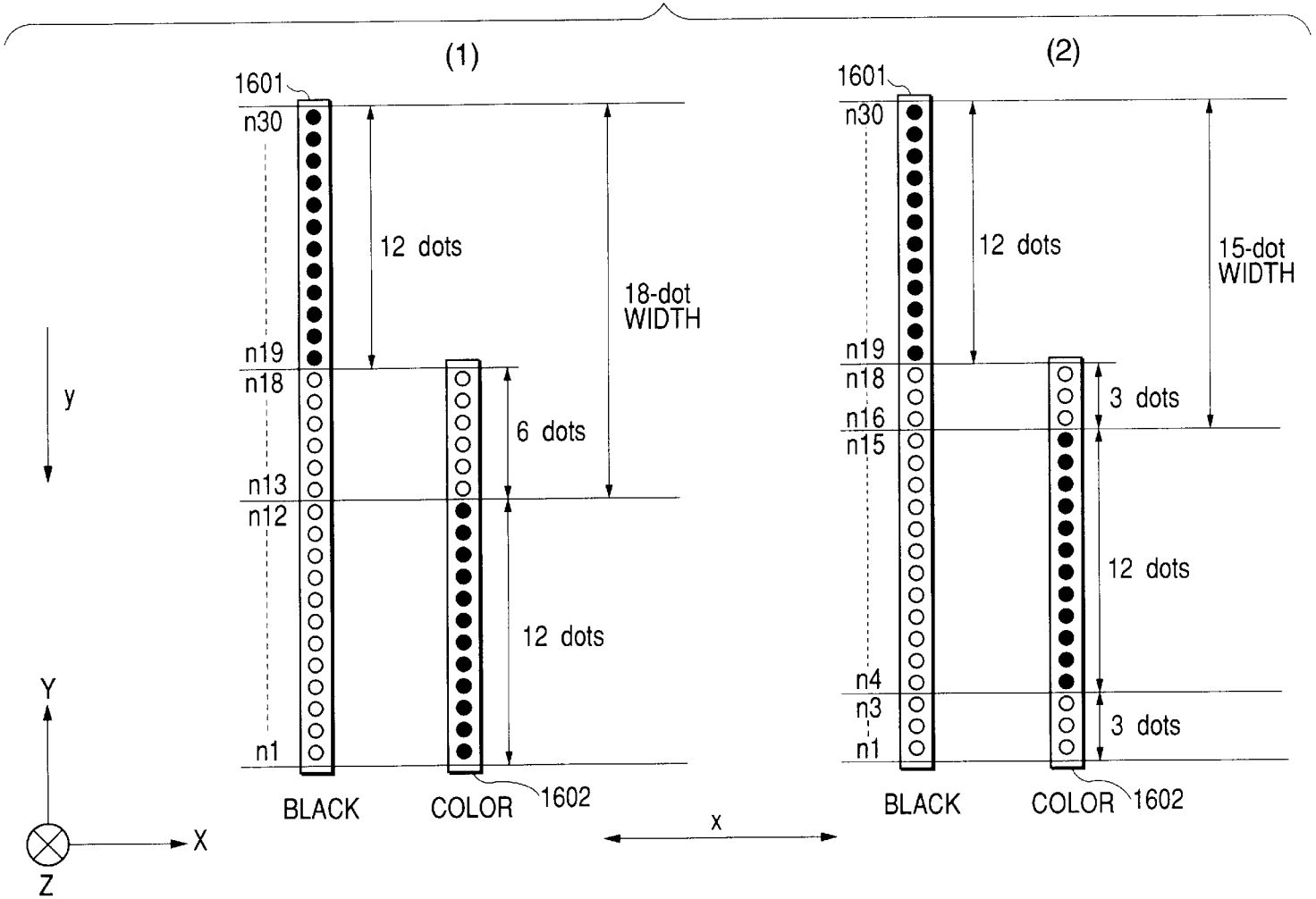
FIG. 16 is a structural view that shows the recording head illustrated in accordance with a second embodiment of the present invention.

FIG. 16 is a view that shows recording dots in accordance with the second embodiment of the present invention. The first recording head 1601 that discharges black ink in FIG. 16 has an arrangement of 30 discharge ports (30 nozzles) (n=30) in the density of N per inch=600 (600 dpi).

For the recording method to be described in the present embodiment, the number of discharge ports of the first recording head 1601 used for discharging black ink are 12 from 19th to 30th (n19 to n30) as shown at (1) in FIG. 16 and (2) in FIG. 16.

Also, the second recording head 1602 that discharges color ink in FIG. 16 has an arrangement of 12 discharge ports (12 nozzles) (n=12) in the density of N per inch=600 (600 dpi). For the recording method to be described in the present embodiment, there are used 12 (n1 to n12) discharge ports from 1st to 12th of the first recording head 1601 as indicated at (1) in FIG. 16 or 12 (n4 to n15) discharge ports from 4th to 15th indicated at (2) in FIG. 16. In this respect, as in the first embodiment, the positional relations of discharge ports (nozzles) of the first recording head and second recording head are such that as to the sub-scanning direction (indicated by an arrow y in FIG. 16), these are identical in the position by the same discharge port numbers, and as to the main scanning direction (indicated by an arrow x in FIG.

16), these are arranged at designated intervals. Also, as in the first embodiment, the first recording head that discharges black ink and the second recording head that discharges color ink are not necessarily limited to the separated mode, but it may be possible to structure a recording head of the type that has discharge ports for black ink use and those for color ink use integrally formed together. Also, the discharge port (nozzle) array is not necessarily limited to the one-line structure as shown in FIG. 16. As described earlier, the structure may be of the checkered flag discharge port arrangement. Also, the discharge port number of the second recording head for color ink use may be structured to be equal to that of the first recording head for black ink use. Also, ink used for the present embodiment is the one used for the first embodiment.

Next, in conjunction with FIG. 12 and FIG. 17, the description will be made of a recording method in accordance with the second embodiment of the present invention.

FIG. 12 is a view that illustrates the three kinds of thinning patterns having the relations to complement each other as described in conjunction with the first embodiment, which correspond to the respective cases where the numbers of the discharge ports are 3 and 6.

Figure 17:
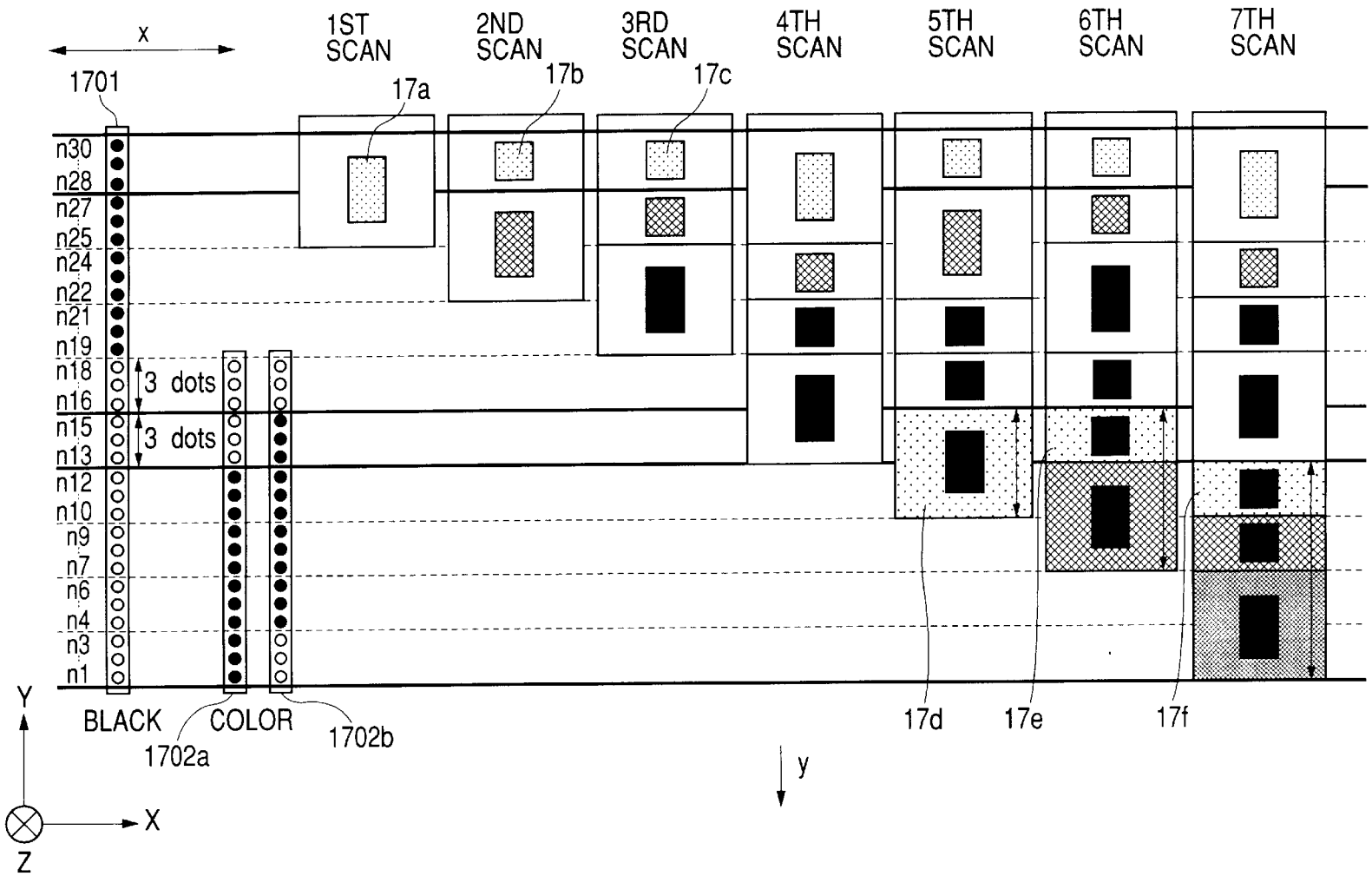
FIG. 17 is a view that illustrates a recording method in accordance with the second embodiment of the present invention.

Also, FIG. 17 is a view that illustrates the recording operation of the present embodiment for each scan of the recording head in the main scanning direction thereof. A reference numeral 1701 in FIG. 17 corresponds to the recording head 1601 for black ink use shown in FIG. 16, and black circles inside the recording head indicate the ink discharge ports to be used for discharging. Also, reference numerals 1702*a* and 1702*b* in FIG. 17 correspond to the recording head for color ink use (the recording 1602 for color ink use in FIG. 16). The reference numeral 1702*a* corresponds to the second recording head 1602 shown at (1) in FIG. 16, which records by use of the 12 discharge ports of n1 to n12. Also, the reference numeral 1702*b* in FIG. 17 corresponds to the second recording head 1602 shown at (2) in FIG. 16, which records by use of 12 discharge ports of n4 to n15. Thus, in accordance with the present embodiment, the recording operation is appropriately executed by use of the discharge ports n1 to n12 indicated at 1702*a* and the discharge ports n4 to n15 indicated at 1702*b*.

At first, with the first scan shown in FIG. 17, recording is executed using 12 nozzles n19 to n30, which are used for discharging among 30 nozzles n1 to n30 provided for the first recording head 1701 (corresponding to the recording head 1601 shown in FIG. 16). For this recording, the 6 nozzles from 25th to 30th (n25 to n30) record by use of the thinning pattern in FIG. 12B1 for the area 17*a* where the black data exist in FIG. 17.

In continuation, a sheet conveying motor is driven to convey the recording medium in the sub-scanning direction for an amount equivalent to a conveying distance of 3 dots/600 dpi.

In the second scan to follow, recording is executed using 12 nozzles of n19 to n30 of the recording head 1701 for black ink use as in the first scan. For this recording, the 6 nozzles from 22nd to 27th (n22 to n27), among 12 nozzles, record by use of the thinning pattern shown at (b2) in FIG. 12 for the area 17*a* where the black data exist in FIG. 17. The 3 nozzles of n28 to n30 record by use of the thinning pattern at (a1) in FIG. 12 for the area 17*b* where the black data exist in FIG. 17.

In continuation, the recording medium is conveyed for a portion of 3 dots/600 dpi, and then, in the third scan to follow, recording is executed using 12 nozzles, n19 to n30, of the first recording head for black ink use for discharging. For this recording, the 6 nozzles of n19 to n24, among 12 nozzles, record by use of the thinning pattern shown at (b3) in FIG. 12 for the area 17*a* where the black data exist in FIG. 17. The 3 nozzles of n25 to n27 record by use of the thinning pattern at (a2) in FIG. 12 for the area 17*b* where the black data exist in FIG. 17. Further, the 3 nozzles of n28 to n30 record by use of the thinning pattern at (a1) in FIG. 12 for the area 17*c* where the black data exist in FIG. 17.

Further, the recording medium is conveyed for a portion of 6 dots/600 dpi, and then, in the fourth scan to follow, recording is executed using 12 nozzles of n19 to n30 as in the previous scan by the recording head 1701 for black ink use, and for the recording by the fourth scan, the 3 nozzles of n19 to n21, among 12 nozzles, record by use of the thinning pattern at (a3) shown in FIG. 12 for the area 17*b* where the black data exist in FIG. 17. The 3 nozzles of n22 to n24 record by use of the thinning patterns at (a2) in FIG. 12 for the area 17*c* where the black data exist in FIG. 17. The 6 nozzles of n25 to n30 record as in the first scan by use of the thinning pattern at (b1) in FIG. 12. Also, in the fourth scan, the area 17*a* where the black data exist in FIG. 17 is not recorded in the fourth scan, because this area has already been completed in the previous scan.

Further, the recording medium is conveyed for a portion of 3 dots/600 dpi, and then, in the fifth scan to follow, recording is executed using 12 nozzles of n19 to n30 of the first recording head 1701 for black ink use, and the 3 nozzles of n19 to n21, among the 12 nozzles, record by use of the thinning pattern at (a3) shown in FIG. 12 for the area 17*c* where the black data exist in FIG. 17. The 9 nozzles of n22 to n30 record each image area as in the second scan. Also, the area 17*b* where the black data exist in FIG. 17 is not recorded in the fifth scan, because the area has already been completed in the previous scan. Also, in the fifth scan, recording is performed using 12 nozzles of n4 to n15, among 15 nozzles of n1 to n15 of the recording head 1602 shown at (2) in FIG. 16, which corresponds to the second recording head 1702*b* for color ink use. For the recording by the recording head for color ink use, the 6 nozzles of n10 to n15, among 12 nozzles, record by use of the thinning pattern at (b1) in FIG. 12 for the area 17*d* where the color data exist in FIG. 17.

Further, the recording medium is conveyed for a portion of 3 dots/600 dpi, and then, in the sixth scan to follow, each black image area is recorded by the recording head 1701 for black ink use in the same manner as the third scan as described earlier. Here, the area 17*c* where the black data exist in FIG. 17 is not recorded, because this area has already been completed in the previous scan. Also, in the sixth scan, the 12 nozzles of n4 to n15, among 15 nozzles of n1 to n15, of the second recording head 1702 for color ink use are used to record at 1602 at (2) in FIG. 16 (1702*b* in FIG. 17). For the recording by the recording head for color ink use, the 6 nozzles of n7 to n12 record by use of the thinning pattern at (b2) in FIG. 12 for the area 17*d* where the color data exists in FIG. 17. Also, the 3 nozzles of n13 to n15 record by use of the thinning pattern at (a1) in FIG. 12 for the area 17*e* where the color data exist in FIG. 17.

Further, the recording medium is conveyed for a portion of 6 dots/600 dpi, and then, in the seventh scan to follow, the recording in black is performed in the same manner as the fourth scan. For the color recording, the 12 nozzles of n1 to n12, among 15 nozzles of n1 to n15 are used to record as shown at 1702*a* in FIG. 17 and 1602 at (1) in FIG. 16. The 6 nozzles of n1 to n6, among 12 nozzles, record by use of the thinning pattern shown at (b3) in FIG. 12 to complete the area 17*d* where the color data exist in FIG. 17. The 3 nozzles of n7 to n9 record by use of the thinning pattern shown at (a2) in FIG. 12 to complete the area 17*e* where the color data exist in FIG. 17. Also, the 3 nozzles of n10 to n12 record by use of the thinning pattern at (a1) in FIG. 12 for the area 17*f* where the color data exist in FIG. 17.

Further, the recording medium is conveyed for a portion of 6 dots/600 dpi, and then, in the eighth scan (not shown), the recording in black is performed in the same manner as the fifth scan. For the color recording, the 15 nozzles of n1 to n15, and 12 nozzles of n4 to n15 are used for discharging to record as shown at 1702*b* in FIG. 17, and 1602 at (2) in FIG. 16. For the recording in the eighth scan, the 3 nozzles of n4 to n6, among 12 nozzles, used for discharging record by use of the thinning pattern shown at (b3) in FIG. 12 for the area 17*e* where the color data exist in FIG. 17. The 3 nozzles of n7 to n9 record by use of the thinning pattern shown at (a2) in FIG. 12 for the area 17*f* where the color data exist in FIG. 17, and the 6 nozzles of n10 to n15 record by use of the thinning pattern shown at (b1) in FIG. 12 in the same manner as the fifth scan.

Further, the recording medium is conveyed for a portion of 3 dots/600 dpi, and then, in the ninth scan (not shown), the recording in black is performed in the same manner as the sixth scan. Also, for the color recording, the 12 nozzles of n4 to n15 are used for recording as shown at 1702*b* in FIG. 17 and 1602 at (2) in FIG. 16. For the color recording in the ninth scan, the 3 nozzles of n4 to n6, among 12 nozzles, used for discharging record by use of the thinning pattern shown at (a3) in FIG. 12 for the area 17*f* where the color data exists in FIG. 17. Also, the 9 nozzles of n7 to n15 record each image area in the same manner as the sixth scan.

Thereafter, the tenth scan performs recording in the same manner as the seventh scan, the eleventh scan, the same as the eighth scan, and the twelfth scan, the same as ninth scan.

As described above, in the case where the recording scan numbers in the main scanning direction are 3 times each for the first discharge port array that discharges black ink and the second discharge port array that discharges color ink for the completion of an image, and then, the conveying amount of a recording medium in the sub-scanning direction is set for two kinds, namely, 6 dots/600 dpi and 3 dots/600 dpi per main scan, the recording scan number m (whereby to complete an image by the first discharge array that discharges black ink) is 3, so (m+a)=(3+1)=4 times (a is 1) with the amount of continuously conveying a recording medium being two kinds, 18 dots/600 dpi of (6+3+3+6) dots/600 dpi and 15 dots/600 dpi of (3+6+3+3) dots/600 dpi or (3+3+6+3) dots/600 dpi. Here, with respect to the first discharge port array that discharges black ink, the position of the leading end portion of the second discharge port array for discharging color ink, which is used from the side in the sheet feeding direction of the recording medium, is set at a length of 18 dots/600 dpi as shown at (1) in FIG. 16 and 1702*a* in FIG. 17, and set at a length of 15 dots/600 dpi as shown at (2) in FIG. 16 and 1702*b* in FIG. 17. In this way, it becomes possible to prevent bleeding from occurring between colors (between black and color), which is characteristic of the multi-pass recording method. In addition, it becomes possible to make the required time constant at all times for recording in color ink in the image area that has been completed by use of black ink, hence producing an effect of preventing color unevenness in the sub-scanning direction that may take place per recording scan.

In this respect, the thinning patterns are arranged to be as fixed ones for the present embodiment, but it may be possible to use random thinning patterns to prevent synchronization with image data or use different thinning patterns per recording head. Also, for the present embodiment, the discharge port number of the second recording head that discharges color ink is set at 15, but it may be possible to use more discharge ports. The second head for discharging color ink, which has the same number of discharge ports as that of the first recording head as shown in FIG. 14, may be used so as to set the number of discharge ports used for discharging by the multi-pass recording method to be 12, n1 to n12 and n4 to n15, respectively. Also, the first recording head that discharges black ink is likewise provided with 30 discharge ports, but with the provision of more or less discharge ports, it may be possible to arrange the discharge ports used for the multi-pass recording method in the positions of 12 ports used for the present embodiment.

Figure 18:
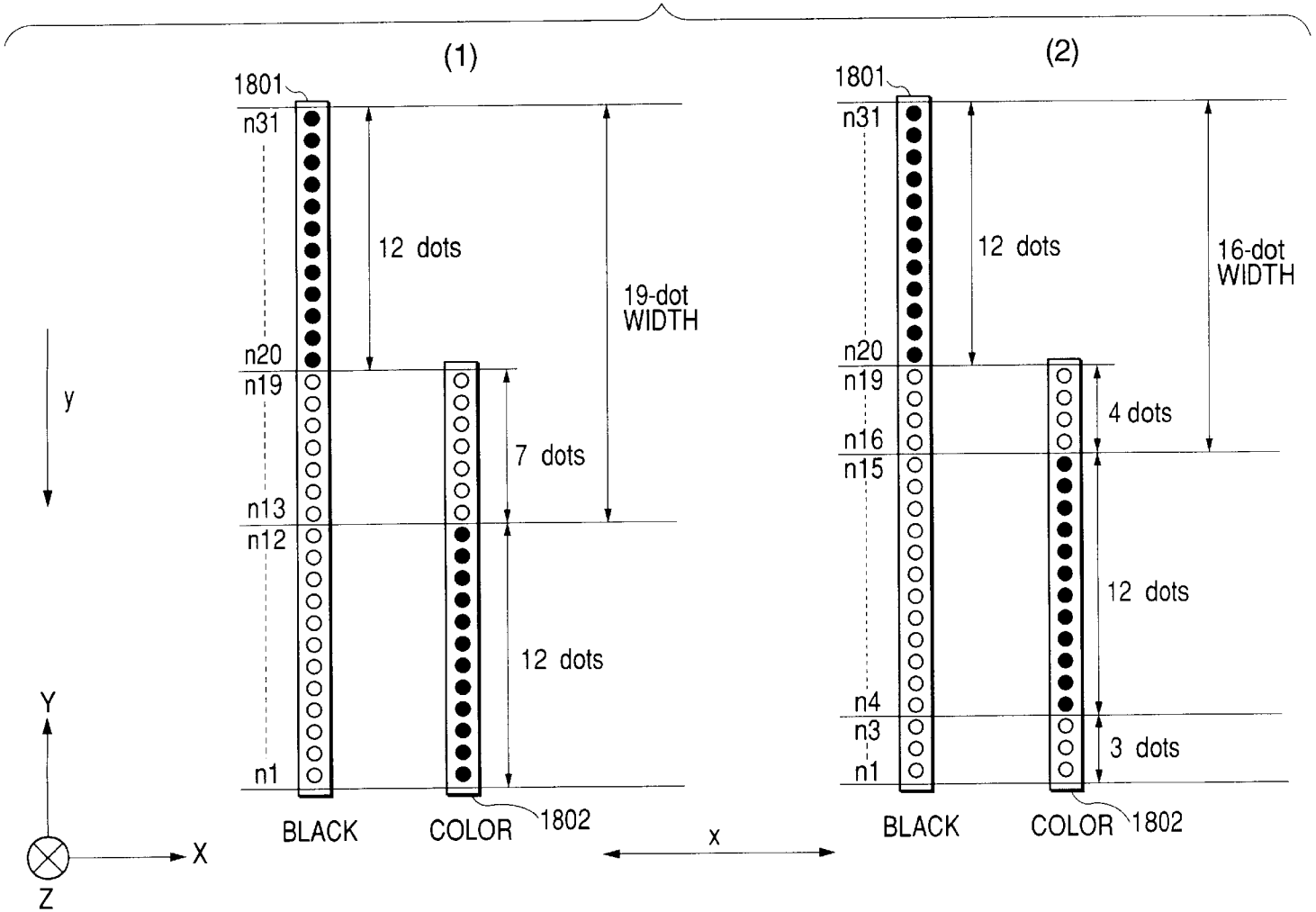
FIG. 18 is a view that schematically shows the structure of the recording head to which the second embodiment of the present invention is applicable.

Also, with respect to the first discharge port array that discharges black ink for the present embodiment, the position of the leading end portion of the second discharge port array for discharging color ink, which is used from the side in the sheet feeding direction of the recording medium, is set at a length of 18 dots/600 dpi as shown at (1) in FIG. 16 and 1702*a* in FIG. 17, and set at a length of 15 dots/600 dpi as shown at (2) in FIG. 16 and 1702*b* in FIG. 17. However, the length is not necessarily limited thereto. As shown in FIG. 18, if the discharge port number of the first discharge port array that discharges black ink is 31 having the length of 19 dots/600 dpi as shown at (1) in FIG. 18, in which (m+a)=(3+1)=4 times (a is 1) with the amount of continuously conveying a recording medium being larger than 18 dots/600 dpi of (6+3+3+6) dots/600 dpi, and (m+a+1)=(3+1+1)=5 times (a is 1) with the amount of conveying the recording medium being smaller than 21 dots/600 dpi of (6+3+3+6+3) dots/600 dpi, and also, having the length of 16 dots/600 dpi as shown at (2) in FIG. 18, in which (m+a)=(3+1)=4 times (a is 1) with the amount of continuously conveying a recording medium being larger than 15 dots/600 dpi of (3+3+6+3) dots/600 dpi or (3+6+3+3) dots/600 dpi, and (m+a+1)=(3+1+1)=5 times (a is 19) with the amount of conveying the recording medium being smaller than 18 dots/600 dpi of (3+3+6+3+3) dots/600 dpi or 21 dots/600 dpi of (3+6+3+3+6) dots/600 dpi, then the end portion of the image completed by use of the discharge port n20 of the first recording head that discharges black ink, and the end portion of the image to be recorded by use of the discharge port n12 or n15 of the second recording head that discharges color ink are away from the present embodiment by 1 dot/600 dpi. Therefore, it becomes possible to obtain a better effect as to the prevention of bleeding between colors of black and others on the boundary portion of the recording scans.

In accordance with the present embodiment, it is possible to provide an ink jet recording apparatus, which is capable of recording high quality images by preventing bleeding between colors in the multi-pass recording method by the execution of controls described above, as well as the recording method having two or more kinds of amounts of conveying a recording medium.

(Third Embodiment)

Figure 19:
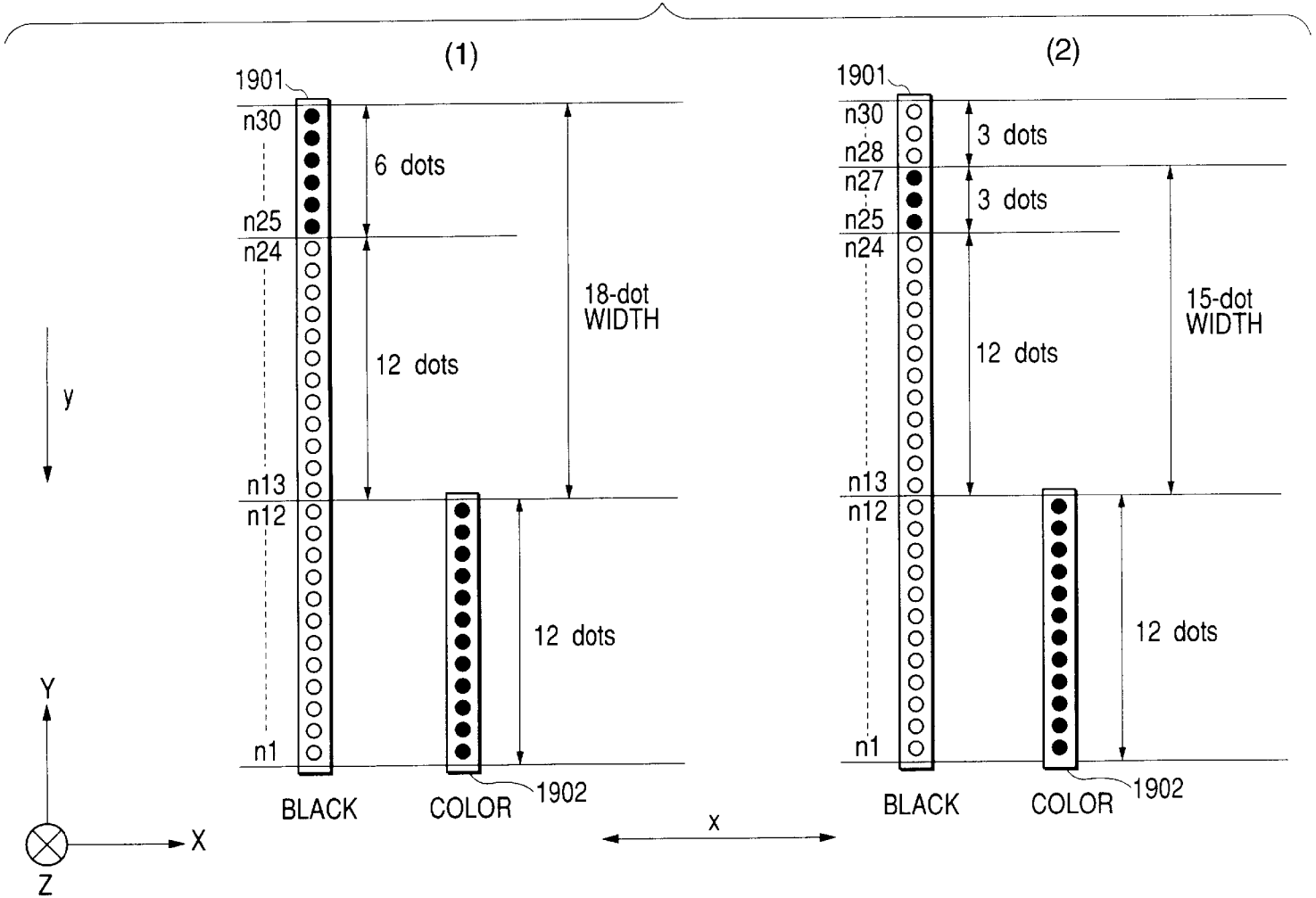
FIG. 19 is a view that schematically shows the structure of a recording head in accordance with a third embodiment of the present invention.

FIG. 19 is a view that schematically shows a recording head and the discharge ports used for recording in accordance with a third embodiment of the present invention.

In FIG. 19, a reference numeral 1901 designates a first recording head for black ink use, which is provided with 30 discharge ports (30 nozzles) (n=30) in the density of N per inch=600 (600 dpi) in the same manner as the recording head 801 in FIG. 8 described for the previous embodiment. In accordance with the present embodiment, recording is executed using 6 discharge ports of n25 to n30 as shown at

Figure 3:
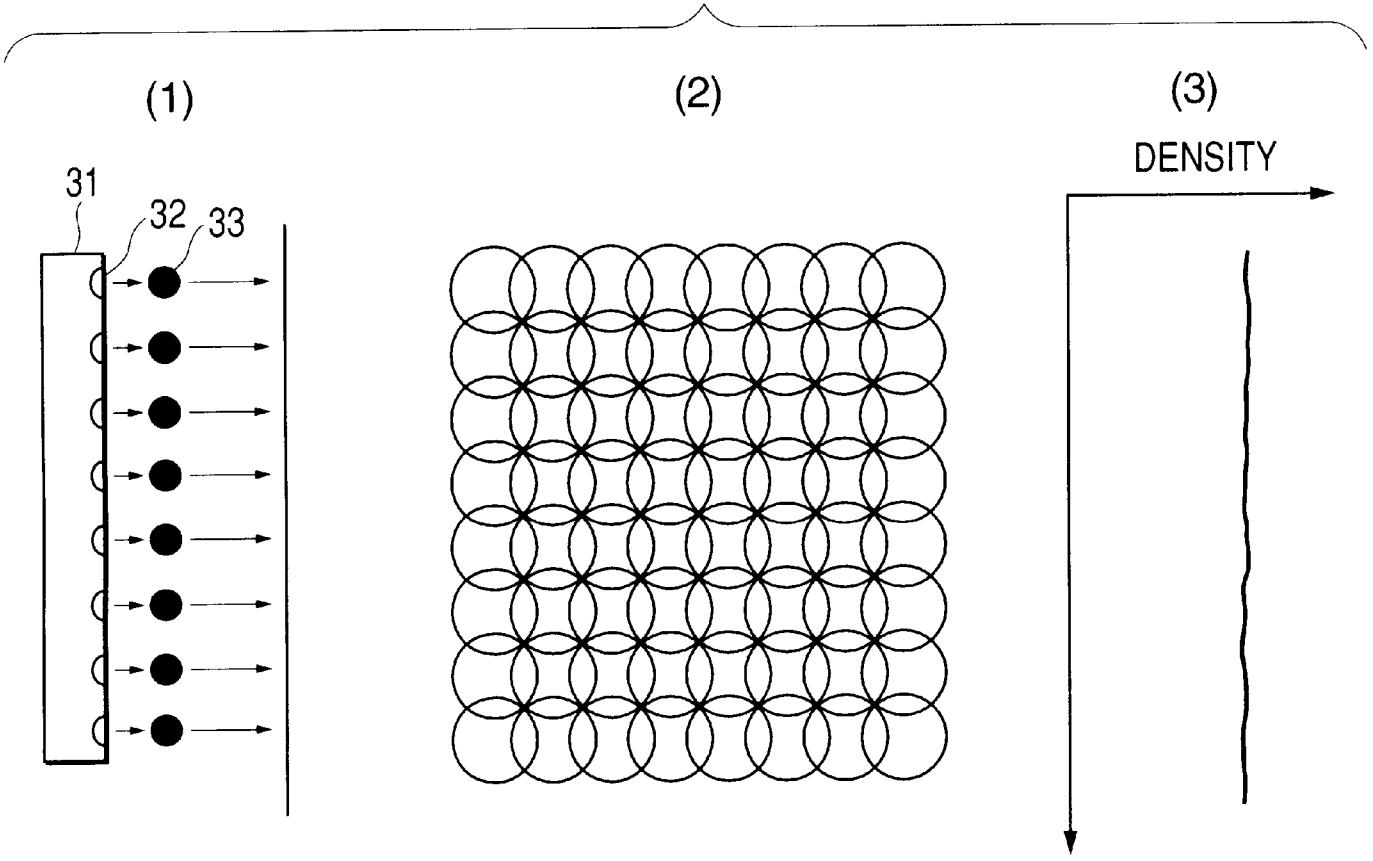
FIG. 3 is a view that illustrates an ideal printing state by an ink jet recording apparatus.
Figure 4:
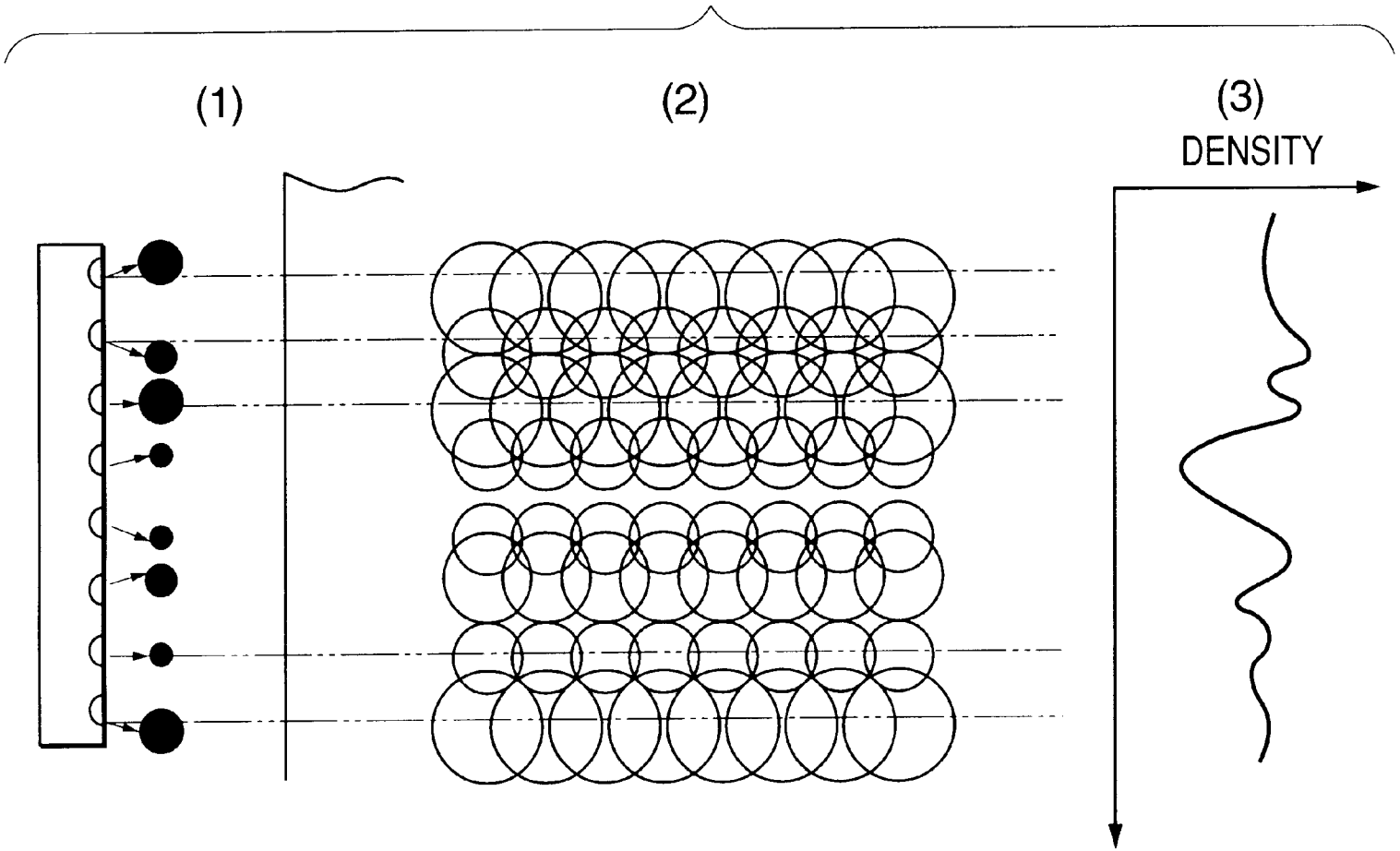
FIG. 4 is a view that illustrates a printing state where density unevenness is created by a recording head.
Figure 5:
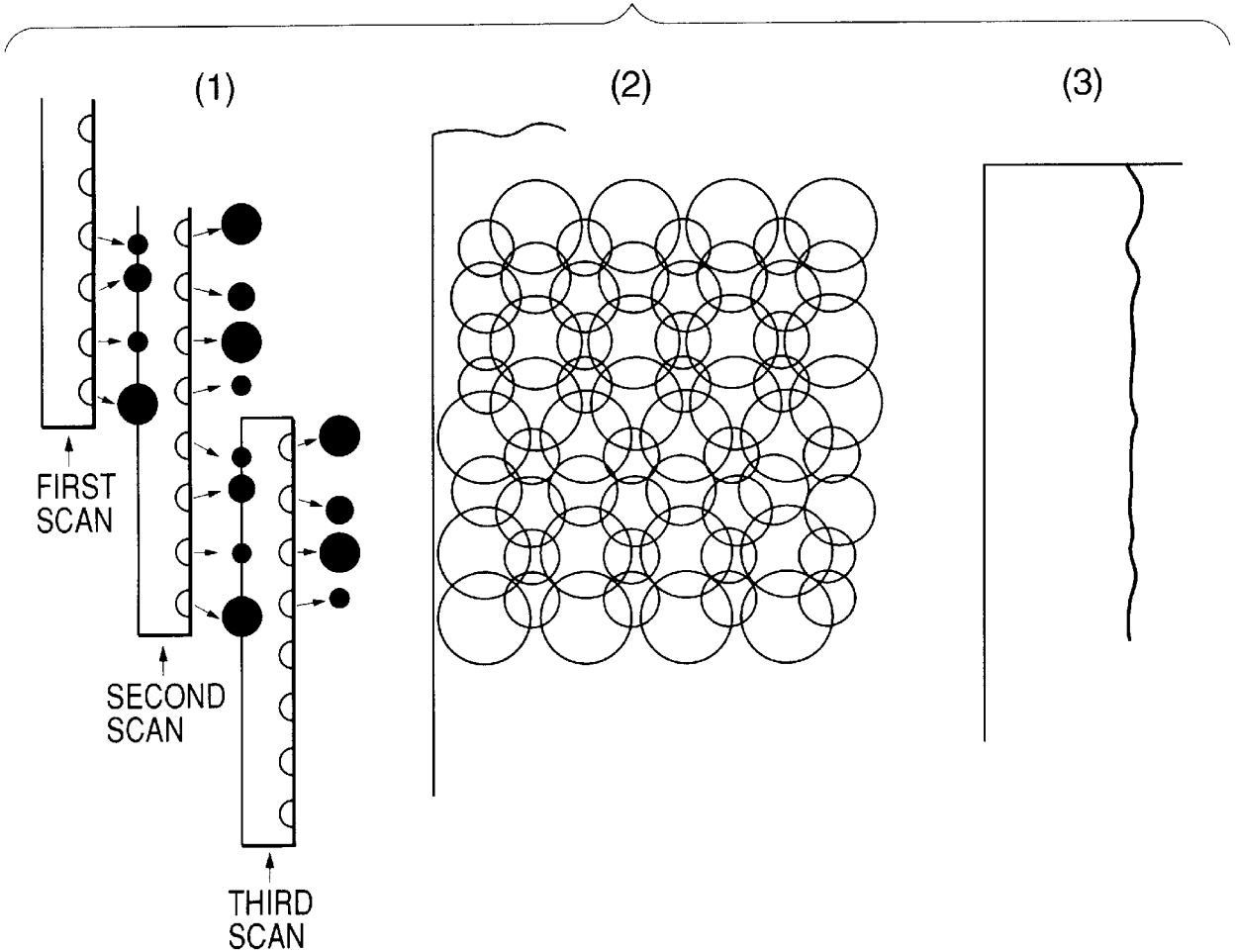
FIG. 5 is a view that illustrates a recording method for reducing density unevenness.
Figure 6A:
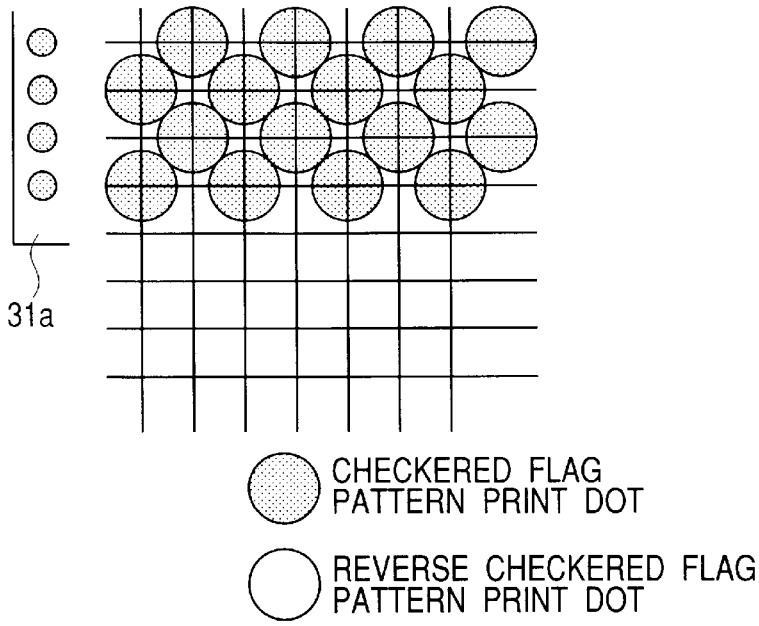
FIGS. 6A, 6B and 6C are views that illustrate another recording method for reducing density unevenness.
Figure 6B:
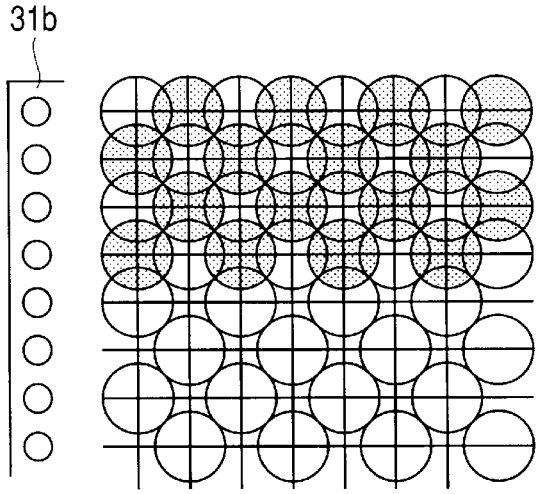
Figure 6C:
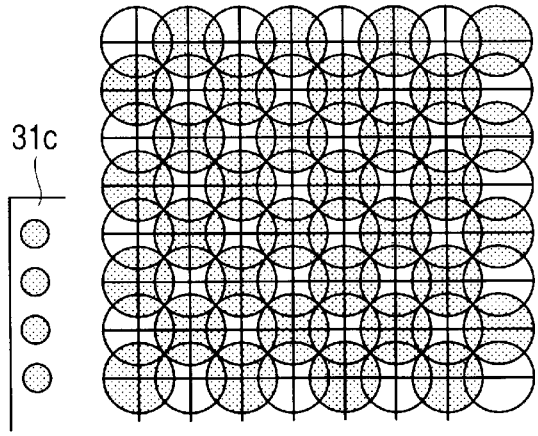

1901 at (1) in FIG. 19 or 3 of n25 to n27 as shown at 1901 at (2) in FIG. 19.

Also, in FIG. 19, a reference numeral 1902 designates a second recording head for color ink use, which is provided with 12 discharge ports (12 nozzles) (n=12) in the density of N per inch=600 (600 dpi) in the same manner as the recording head shown in FIG. 8. In accordance with the present embodiment, the second recording head 1902 executes recording by use of all the 12 discharge ports of n1 to n12 thereof.

Also, the positional relations between the discharge ports (nozzles) of each recording head are the same as those in the previous embodiment, and in the sub-scanning direction, the arrangement is identical in the positions of the same discharge port numbers. In the main scanning direction, the arrangement is made at designated intervals. In this respect, the recording head that discharges black ink and the recording head that discharges color ink are not necessarily of the separate type as described for the first embodiment, but may be structured as a recording head of integrated type. Also, the discharge port (nozzle) array is not necessarily arranged in one line, but may be arranged in the form of the checkered flag. Also, it may be possible to structure so that the number of discharge ports of the second recording head is equal to that of the first recording head. Also, ink used for the present embodiment is the one used for the first embodiment.

Next, with reference to FIG. 12, and FIG. 20, the description will be made of the recording method in accordance with the third embodiment of the present invention.

FIG. 12 is a view that illustrates 3 kinds of thinning patterns that complement each other as described in detail in the previous embodiment.

Figure 20:
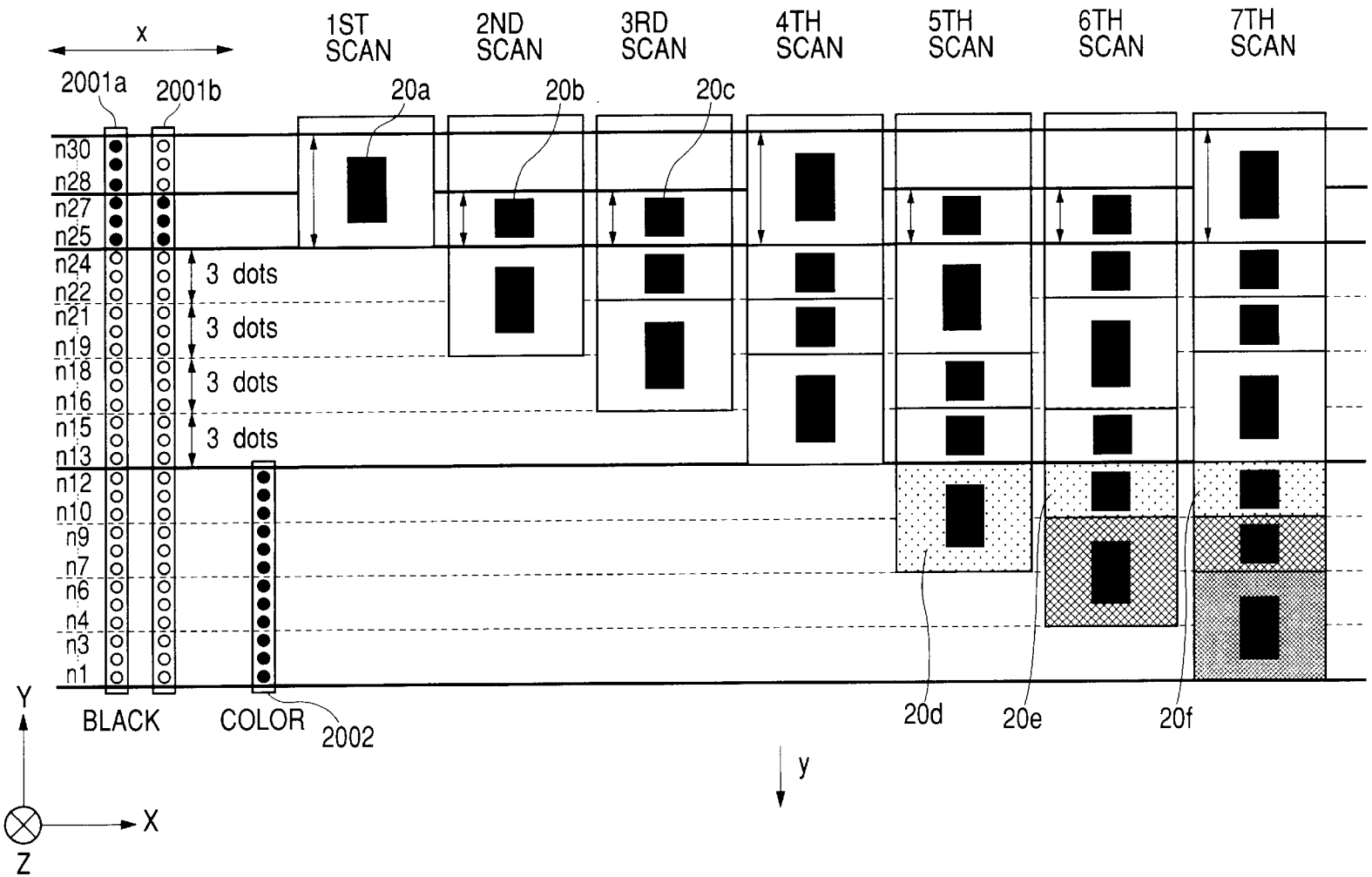
FIG. 20 is a view that illustrates a recording method in accordance with the third embodiment of the present invention.

Also, FIG. 20 is a view that illustrates the recording operation corresponding to each scan of the recording head in the main scanning direction.

In FIG. 20, reference numerals 2001*a* and 2001*b* designate a first recording head for black ink use, and indicate the states where the discharge ports, which are enabled to discharge, are made different for the same recording head for black ink use. Also, a reference numeral 2002 designates a second recording head for color ink use. In FIG. 20, black circles in the recording head indicate the discharge ports used for discharging ink.

The head shown at 2001*a* in FIG. 20 corresponds to the first recording head 1901 shown at (1) in FIG. 19, and indicates that among the discharge ports of n1 to n30, 6 discharge ports of n25 to n30 are used for recording. Also, the head shown at 2001*b* in FIG. 20 corresponds to the first recording head 1901 shown at (2) in FIG. 19, and indicates that 3 discharge ports of n25 to n27 are used for recording. Also, the head at 2002 corresponds to the second recording head 1902 at (1) and (2) in FIG. 19.

Thus, in accordance with the present embodiment, the first recording head for black ink use performs recording appropriately using the discharge ports of n25 to n30 shown at 2001*a* and those of n25 to n27 shown at 2001*b*.

Hereunder, with reference to FIG. 20, the detailed description will be made of the recording operation in accordance with the order of recording scans.

At first, with the first scan, recording is executed using 6 nozzles n25 to n30, which are used for discharging among 30 nozzles n1 to n30 provided for the first recording head for black ink use shown at 2001*a* in FIG. 20, to record for the area 20*a* where the black data exist in FIG. 20 by means of the one-pass recording method. Here, the one-pass recording method is the one in which recording is performed without using the thinning patterns shown in FIG. 12, and the image in the target area is completed by one main scan.

In continuation, a sheet conveying motor is driven to convey the recording medium in the sub-scanning direction for an amount equivalent to a conveying distance of 6 dots/600 dpi. Then, in the second scan to follow, recording is executed using 3 nozzles of n25 to n27 of the recording head for black ink use shown at 2001*b* in FIG. 20 for the area 20*b* where the black data exist in FIG. 20 by means of the one-pass recording method. Here, the area 20*a* where the black data exist in FIG. 20 has already been completely recorded by the first scan.

In continuation, the recording medium is conveyed for a portion of 3 dots/600 dpi, and recording is performed with the third scan to follow. For recording in the third scan, the areas 20*a* and 20*b* where the black data exist as indicated in FIG. 20 have already been recorded completely in the previous first scan and second scan. Therefore, in this third scan, the area 20*c* where black data are indicated in FIG. 20 are recorded using the 3 nozzles of n25 to n27 of the recording head for black ink use as shown at 2001*b* in FIG. 20 by means of the one-pass recording method.

Further, the recording medium is conveyed for a portion of 3 dots/600 dpi, and recording is performed with the fourth scan to follow. Prior to the fourth scan, the areas 20*a*, 20*b*, and 20*c* where the black data are indicated in FIG. 20 have already been recorded completely. In the fourth scan, recording by the recording head for black ink use is executed in the same manner as the first scan.

Further, the recording medium is conveyed for a portion of 6 dots/600 dpi, and in the fifth scan to follow, recording by the recording head for black ink use is executed in the same manner as the second scan. Also, recording by the recording head 2002 for color ink use (corresponding to the second recording head 1902 in FIG. 19) is executed using 6 nozzles of n7 to n12 among all the 12 nozzles to record by use of the thinning pattern shown at (b1) in FIG. 12 for the area 20*d* where the color data are indicated in FIG. 20.

Further, the recording medium is conveyed for a portion of 3 dots/600 dpi, and in the sixth scan to follow, recording by the recording head for black ink use is executed in the same manner as the third scan. Also, recording by the recording head 2002 for color ink use is executed using 6 nozzles of n4 to n9 among all the 12 nozzles to record by use of the thinning pattern shown at (b2) in FIG. 12 for the area 20*d* where the color data exist in FIG. 20, and also, using 3 nozzles of n10 to n12 to record by use of the thinning pattern shown at (a1) in FIG. 12 for the area 20*e* where the color data exist in FIG. 20.

Further, the recording medium is conveyed for a portion of 3 dots/600 dpi, and in the seventh scan to follow, recording by the recording head for black ink use is performed in the same manner as the fourth scan. Also, recording by the recording head 2002 for color ink use is executed using 6 nozzles of n1 to n6 among all the 12 nozzles to record by use of the thinning pattern shown at (b3) in FIG. 12 for the completion of the area 20*d* where the color data exist in FIG. 20, while recording by use of 3 nozzles of n7 to n9 and the thinning pattern shown at (a2) in FIG. 12 for the area 20*e* where the color data exist in FIG. 20, as well as recording by use of 3 nozzles of n10 to n12 and the thinning pattern shown at (a1) in FIG. 12 for the area 20*f* where the color data are indicated in FIG. 20.

Further, the recording medium is conveyed for a portion of 6 dots/600 dpi, and in the eighth scan (not shown), recording by the recording head for black ink use is performed in the same manner as the fifth scan. Also, recording by the recording head 2002 for color ink use is executed using 3 nozzles of n1 to n3 among all the 12 nozzles to record by use of the thinning pattern shown at (a3) in FIG. 12 for the completion of the area 20*e* where the color data exist in FIG. 20, while recording by use of 3 nozzles of n4 to n6 and the thinning pattern shown at (a2) in FIG. 12 for the area 20*f* where the color data exist in FIG. 20. Also, recording is performed in the same manner as the fifth scan using 6 nozzles of n7 to n12 and the thinning pattern shown at (b1) in FIG. 12.

Further, the recording medium is conveyed for a portion of 3 dots/600 dpi, and in the ninth scan (not shown), recording by the recording head for black ink use is performed in the same manner as the sixth scan. Also, recording by the recording head 2002 for color ink is performed to complete the area 20*f* where the color data exist as indicated in FIG. 20 by use of 3 nozzles of n1 to n3 among all the 12 nozzles and the thinning pattern shown at (a3) in FIG. 12. Then, with the 9 nozzles of n4 to n12, each of the image areas is recording in the same manner as the sixth scan.

Thereafter, the tenth scan performs recording in the same manner as the seventh scan, the eleventh scan, the same as the eighth scan, and the twelfth scan, the same as ninth scan.

For the recording method of the present embodiment described above, the number of recording scans in the main scanning direction whereby to complete an image by the discharge port array of the first recording head that discharges black ink is set at one, and the number of recording scans in the main scanning direction whereby to complete the image by the second recording head that discharges color ink is set at three. The numbers are different for black and color. In this recording method where the conveying amount of a recording medium in the sub-scanning direction is set for two kinds, namely, 6 dots/600 dpi and 3 dots/600 dpi per main scan, the recording scan number m (whereby to complete an image by the first discharge array that discharges black ink) is 1, so (m+a)=(1+3)=4 times (a is 3) with the amount of continuously conveying a recording medium being two kinds, 18 dots/600 dpi of (6+3+3+6) dots/600 dpi and 15 dots/600 dpi of (3+3+6+3) dots/600 dpi or (3+6+3+3) dots/600 dpi. Here, utilizing the present invention, the position of the leading end portion of the second discharge port array for discharging color ink, which is used from the side in the sheet feeding direction of the recording medium, is set at a length of 18 dots/600 dpi as shown at (1) in FIG. 19 and 2001*a* in FIG. 20, and set at a length of 15 dots/600 dpi as shown at (2) in FIG. 19 and 2001*b* in FIG. 20 with respect to the first discharge port array that discharges black ink. In this way, it becomes possible to prevent bleeding from occurring between colors (between black and color), which is characteristic of the multi-pass recording method, by means of the multi-pass recording method whereby to complete an image with the three-time recording scan of the second recording head that discharges color ink even in the case of the combination with the one-pass recording method whereby to complete an image by the one-time scanning of the first recording head that discharges black ink. In addition, it becomes possible to make the required time constant at all times for recording in color ink in the image area that has been completed by use of black ink, hence producing an effect of preventing color unevenness in the sub-scanning direction that may take place per recording scan.

In this respect, the thinning patterns are arranged to be as fixed ones for the present embodiment, but it may be possible to use random thinning patterns to prevent synchronization with image data or use different thinning patterns per recording head. Also, for the present embodiment, the discharge port number of the second recording head that discharges color ink is set at 12 and all of them are used, but it may be possible to use more discharge ports. The second head for discharging color ink, which has the same number of discharge ports as that of the first recording head as shown in FIG. 14, may be used so as to set the discharge ports used for discharging by the multi-pass recording method to be 12 of n1 to n12. Also, the first recording head that discharges black ink is likewise provided with 30 discharge ports, but with the provision of more or less discharge ports, it may be possible to arrange the discharge ports used for the multi-pass recording method in the positions of 6 ports or 3 ports used for the present embodiment.

Figure 21:
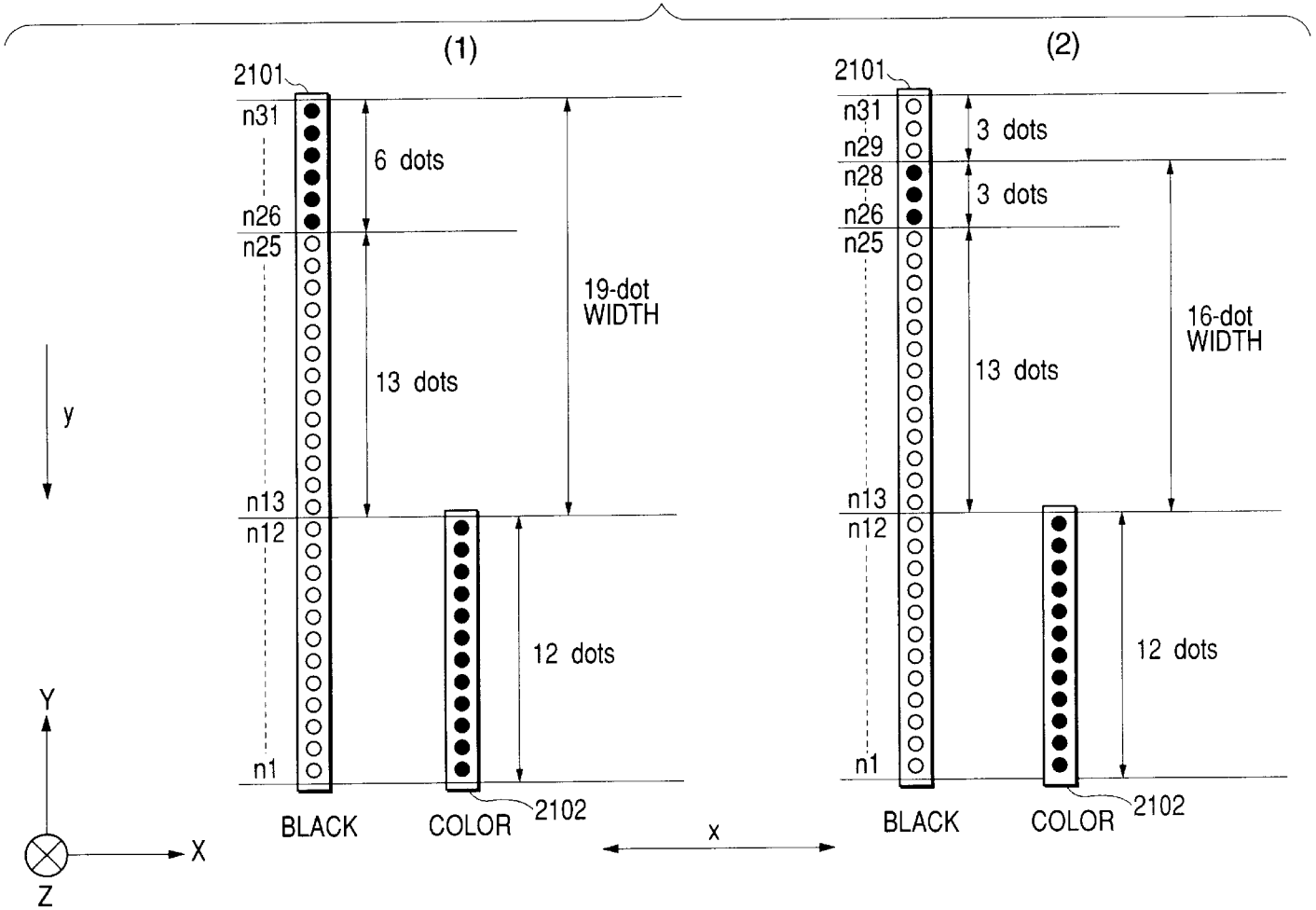
FIG. 21 is a view that schematically shows the structure of the recording head to which the third embodiment of the present invention is applicable.

Also, with respect to the first discharge port array that discharges black ink for the present embodiment, the position of the leading end portion of the second discharge port array for discharging color ink, which is used from the side in the sheet feeding direction of the recording medium, is set at a length of 18 dots/600 dpi as shown at (1) in FIG. 19 and 2001*a* in FIG. 20, and set at a length of 15 dots/600 dpi as shown at (2) in FIG. 19 and 2001*b* in FIG. 20. However, the length is not necessarily limited thereto. As shown in FIG. 21, if the discharge port number of the first discharge port array that discharges black ink is 31 having the length of 19 dots/600 dpi as shown at (1) in FIG. 21, in which (m+a)=(1+3)=4 times (a is 3) with the amount of continuously conveying a recording medium being larger than 18 dots/600 dpi of (6+3+3+6) dots/600 dpi, and (m+a+1)=(1+3+1)=5 times (a is 3) with the amount of conveying the recording medium being smaller than 21 dots/600 dpi of (6+3+3+6+3) dots/600 dpi, and also, having the length of 16 dots/600 dpi as shown at (2) in FIG. 21, in which (m+a)=(1+3)=4 times (a is 3) with the amount of continuously conveying a recording medium being larger than 15 dots/600 dpi of (3+3+6+3) dots/600 dpi or (3+6+3+3) dots/600 dpi, and (m+a+1)=(1+3+1)=5 times (a is 3) with the amount of conveying the recording medium being smaller than 18 dots/600 dpi of (3+3+6+3+3) dots/600 dpi or 21 dots/600 dpi of (3+6+3+3+6) dots/600 dpi, then the end portion of the image completed by use of the discharge port n26 of the first recording head that discharges black ink, and the end portion of the image to be recorded by use of the discharge port n12 of the second recording head that discharges color ink are away from the present embodiment by 1 dot/600 dpi. Therefore, it becomes possible to obtain a better effect with regard to the prevention of bleeding between colors of black and others on the boundary portion of the recording scans.

In accordance with the present embodiment, it is possible to provide an ink jet recording apparatus, which is capable of recording high quality images by preventing bleeding between colors even in the combination of different multi-pass numbers, such as a combination of the one-pass recording method and three-pass recording method by the execution of controls described above, as well as in the recording method having two or more modes of conveying amounts of a recording medium.

(Fourth Embodiment)

Next, with reference to the accompanying drawings, the description will be made of a fourth embodiment in accordance with the present invention.

Figure 22:
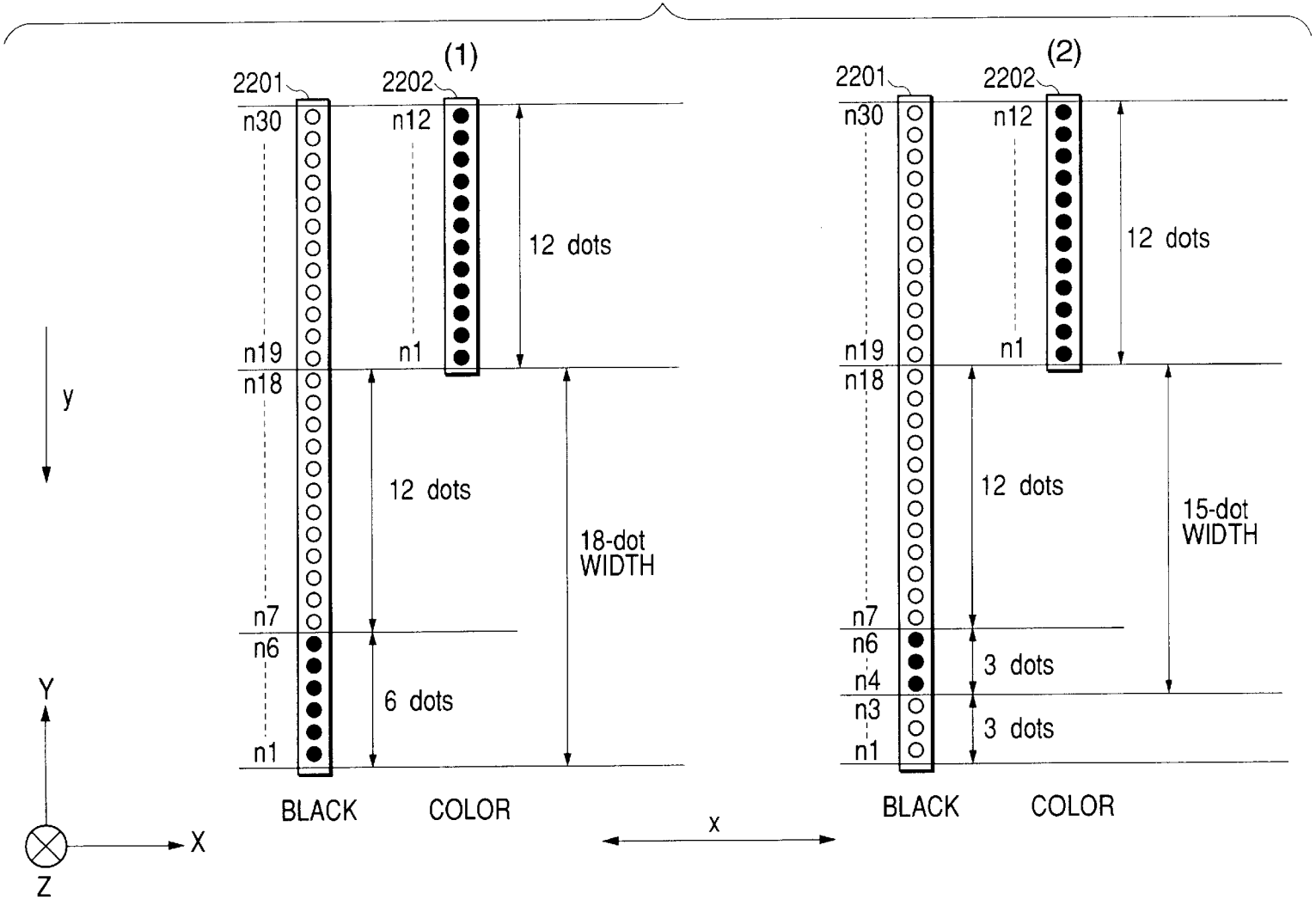
FIG. 22 is a view that schematically shows the structure of the recording head to which a fourth embodiment of the present invention is applicable.

FIG. 22 is a view that schematically shows the arrangement of recording head in accordance with the fourth embodiment of the present invention, and the nozzles used for discharging ink when recording is performed. The black circles indicate such nozzles used for discharging ink as in the drawings referred to in the descriptions previously made.

The first recording head 2201, which discharges black ink as shown at (1) and (2) in FIG. 22, is provided with 30 discharge ports (30 nozzles) (n=30) in the density of N per inch=600 (600 dpi). For the recording method of the present embodiment, the discharge ports used for discharging ink are defined to be 6 of n1 to n6 shown at 2201 at (1) in FIG. 22 or 3 of n4 to n6 shown at 2201 at (2) in FIG. 22, and these are used appropriately for the recording operation as required.

Also, the second recording head 2202 in FIG. 22, which discharges color ink, is provided with 12 discharge ports (12 nozzles) (n=12) in the density of N per inch=600 (600 dpi). For the recording method of the present embodiment, all the 12 discharge ports of n1 to n12 of the second recording head 2202 for color ink are used for recording. Also, the positional relations of discharge ports (nozzles) are such that as to the sub-scanning direction, the discharge port numbers, n19 to n30, of the recording head that discharges black ink are arranged to be identical to the position of the discharge port numbers, n1 to n12, of the recording head that discharges color ink, and as to the main scanning direction, these are arranged at designated intervals. In this respect, as described in conjunction with the first embodiment, the recording head that discharges black ink and the recording head that discharges color ink are not necessarily limited to the separated mode, but it may be possible to structure a recording head as an integrated type or arrange a structure of the checkered flag type, not necessarily arranging the discharge ports (nozzles) in one line. Also, the discharge port number of the second recording head may be arranged to be equal to that of the first recording head. Also, ink used for the present embodiment is the one used for the first embodiment.

Next, in conjunction with FIG. 12 and FIG. 23, the description will be made of a recording method in accordance with the fourth embodiment of the present invention. FIG. 12 is a view that illustrates the three kinds of thinning patterns having the relations to complement each other as described earlier. Also, reference numerals 2301*a* and 2301*b* in FIG. 23 designate the recording head for black ink use. Then, as described earlier, the black circles inside the recording head indicate the discharge ports used for discharging ink. The reference numeral 2301*a* in FIG. 23 corresponds to the first recording head 2201 at (1) in FIG. 22, which indicates that 6 discharge ports of n1 to n6 are used for recording. Also, the reference numeral 2301*b* in FIG. 23 corresponds to the first recording head 2201 at (2) in FIG. 22, which indicates that 3 discharge ports of n4 to n6 are used for recording. Also, the reference numeral 2302 in FIG. 23 corresponds to the second recording head 2202 in FIG. 22 for color ink use. Thus, regarding the first recording head 2201 (FIG. 22) of the present embodiment, the recording operation is appropriately executed by use of the discharge ports n1 to n6 indicated at 2301*a* in FIG. 23 and the discharge ports n4 to n6 indicated at 2301*b* in FIG. 23.

Figure 23:
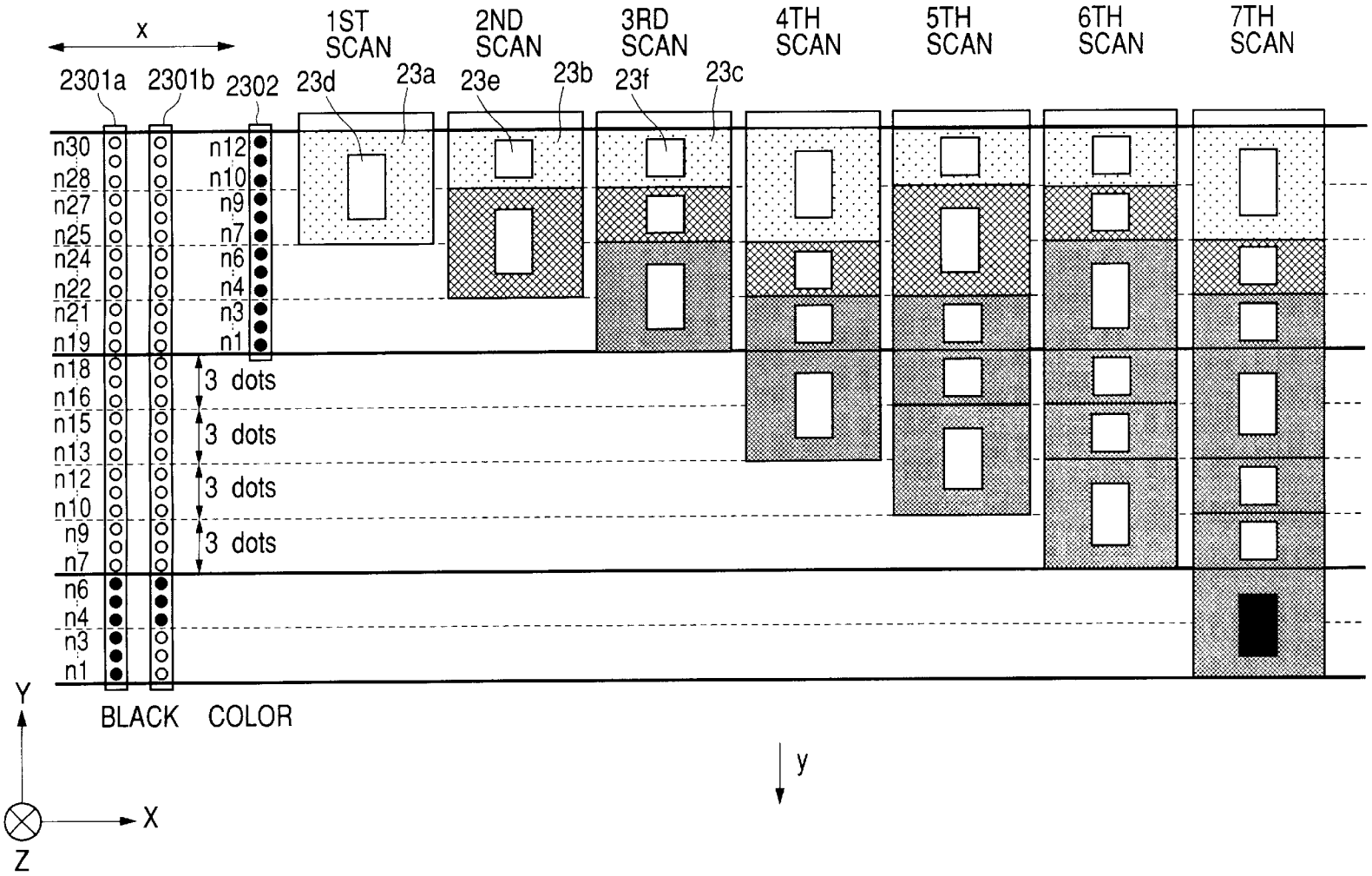
FIG. 23 is a view that illustrates a recording method in accordance with the fourth embodiment of the present invention.

At first, with the first scan shown in FIG. 23, recording is executed using 6 nozzles of n7 to n12, among the 12 nozzles, used for discharging of the recording head 2302 for color ink to record by use of the thinning pattern at (b1) in FIG. 12 for the area 23*a* where the color data exist in FIG. 23.

In continuation, a sheet conveying motor is driven to convey the recording medium in the sub-scanning direction for an amount equivalent to a conveying distance of 3 dots/600 dpi.

In the second scan to follow this sheet conveying operation, recording is executed using 6 nozzles of n4 to n9, among the 12 nozzles, of the recording head 2302 that discharges color ink to record by use of the thinning pattern shown at (b2) in FIG. 12 for the area 23*a* where the color data exist in FIG. 23. Also, the 3 nozzles of n10 to n12 record by use of the thinning pattern at (a1) in FIG. 12 for the area 23*b* where the color data exist in FIG. 23.

In continuation, the recording medium is conveyed for a portion of 3 dots/600 dpi, and in the third scan to follow, recording is executed using 6 nozzles of n1 to n6, among the entire 12 nozzles of the recording head 2302 for color ink use to record by use of the thinning pattern shown at (b3) in FIG. 12 for the area 23*a* where the color data exist in FIG. 23. Also, the 3 nozzles of n7 to n9 record by use of the thinning pattern shown at (a2) in FIG. 12 for the area 23*b* shown in FIG. 23. Also, the 3 nozzles of n10 to n12 record by use of the thinning pattern at (a1) in FIG. 12 for the area 23*c* where the color data exist in FIG. 23.

Further, the recording medium is conveyed for a portion of 6 dots/600 dpi, and in the fourth scan to follow, recording is executed using 3 nozzles of n1 to n3, among the entire 12 nozzles of the recording head 2301 for color ink use, to record by use of the thinning pattern shown at (a3) in FIG. 12 for the area 23*b* where the color data exist in FIG. 23. The 3 nozzles of n4 to n6 record by use of the thinning patterns at (a2) in FIG. 12 for the area 23*c* where the color data exist in FIG. 23. The 6 nozzles of n7 to n12 record by use of the thinning pattern at (b1) in FIG. 12 for the corresponding area as in the first scan. Also, in the fourth scan, the area 23*a* where the color data exist in FIG. 23 is not recorded, because this area has already been recorded completely.

Further, the recording medium is conveyed for a portion of 3 dots/600 dpi, and in the fifth scan to follow, recording is executed using 3 nozzles of n1 to n3, among the entire 12 nozzles, of the second recording head 2302 for color ink use to record by use of the thinning pattern shown at (a3) in FIG. 12 for the area 23*c* where the color data exist in FIG. 23. The 9 nozzles of n4 to n12 record the image area to which each nozzle corresponds as in the second scan. Also, the area 23*b* where the color data exist in FIG. 23 is not recorded in the fifth scan, because the area has already been completed in the previous scan.

Further, the recording medium is conveyed for a portion of 3 dots/600 dpi, and in the sixth scan to follow, the recording by the second recording head 2302 for color ink use is performed in the same manner as the third scan. Here, the color data area 23*c* shown in FIG. 23 has been recorded completely in the previous scan.

Further, the recording medium is conveyed for a portion of 6 dots/600 dpi, and in the seventh scan to follow, the recording by the second recording head 2302 is performed in the same manner as the fourth scan. Also, the recording by the first recording head for black ink use is performed using 6 nozzles of n1 to n6, among the 30 nozzles of n1 to n30 for the black data area 23*d* indicated in FIG. 23 by means of the one-pass recording method. The discharge ports of the second recording head for black ink use, which are used for recording in this scan, are indicated at 2301*a* in FIG. 23 and 2201 at (1) in FIG. 22.

Further, the recording medium is conveyed for a portion of 3 dots/600 dpi, and in the eighth scan (not shown), the recording in color is performed in the same manner as the fifth scan. Also, at the time of this scanning, the area 23*d* where the black data exist in FIG. 23 has already been recorded completely in the previous recording scan. Therefore, regarding the recording by the second recording head for black ink use, the area 23*e* where the black data exist in FIG. 23 is recorded by means of the one-pass recording method using 3 nozzles of n4 to n6, among the 30 nozzles of n1 to n30, of the recording head 2201 shown at 2301*b* in FIG. 23 and at (2) in FIG. 22.

Further, the recording medium is conveyed for a portion of 3 dots/600 dpi, and in the ninth scan (not shown), the recording in color is performed in the same manner as the sixth scan. Also, at time of this scanning, the area 23*e* where the black data exist in FIG. 23 has already been recorded completely. Therefore, regarding the recording by the recording head for black ink use, the area 23*f* where the black data exist in FIG. 23 is recorded by means of the one-pass recording method using 3 nozzles of n4 to n6, among the entire 30 nozzles, of the recording head 2201 shown at 2301*b* in FIG. 23 and at (2) in FIG. 22.

Thereafter, the tenth scan performs recording in the same manner as the seventh scan, the eleventh scan, the same as the eighth scan, and the twelfth scan, the same as ninth scan.

As described above, in the case where the number of recording scans in the main scanning direction whereby to complete an image by the first discharge port array that discharges black ink is set at one, and the number of recording scans in the main scanning direction whereby to complete the image by the second discharge port array that discharges color ink is set differently at three, and the conveying amount of a recording medium in the sub-scanning direction is set for two kinds, namely, 6 dots/600 dpi and 3 dots/600 dpi per main scan, the recording scan number m (whereby to complete an image by the first discharge array that discharges black ink) is 1, so (m+a)=(1+3)=4 times (a is 3) with the amount of continuously conveying a recording medium being two kinds, that is, 18 dots/600 dpi of (6+3+3+6) dots/600 dpi and 15 dots/600 dpi of (3+3+6+3) dots/600 dpi or (3+6+3+3) dots/600 dpi. Here, utilizing the present invention, the position of the leading end portion of the second discharge port array for discharging color ink, which is used from the side in the sheet feeding direction of the recording medium, is set at a length of 18 dots/600 dpi as shown at (1) in FIG. 22 and 2301*a* in FIG. 23, and set at a length of 15 dots/600 dpi as shown at (2) in FIG. 22 and 2301*b* in FIG. 23 with respect to the first discharge port array that discharges black ink. In this way, it becomes possible to prevent bleeding from occurring between colors (between black and color), which is characteristic of the multi-pass recording method, by means of the multi-pass recording method whereby to complete an image with the first recording head that discharges black ink subsequent to having completed the image by means of the multi-pass recording method using the second recording head that discharges color ink. In addition, it becomes possible to make the required time constant at all times for recording in color ink in the image area that has been completed by use of black ink, hence producing an effect of preventing color unevenness in the sub-scanning direction that may take place per recording scan.

In this respect, the thinning patterns are arranged to be as fixed ones for the present embodiment, but it may be possible to use random thinning patterns to prevent synchronization with image data or use different thinning patterns per recording head. Also, for the present embodiment, the discharge port number of the second recording head that discharges color ink is set at 12 and all of them are used, but it may be possible to use more discharge ports. The second head for discharging color ink, which has the same number of discharge ports as that of the first recording head as shown in FIG. 14, may be used so as to set the number of discharge ports used for discharging by the multi-pass recording method to be 12, n19 to n30. Also, the first recording head that discharges black ink is likewise provided with 30 discharge ports, but with the provision of more or less discharge ports, it may be possible to arrange the number of discharge ports used for the multi-pass recording method to be 6, n1 to n6, or 3, n4 to n6, for the present embodiment.

Figure 24:
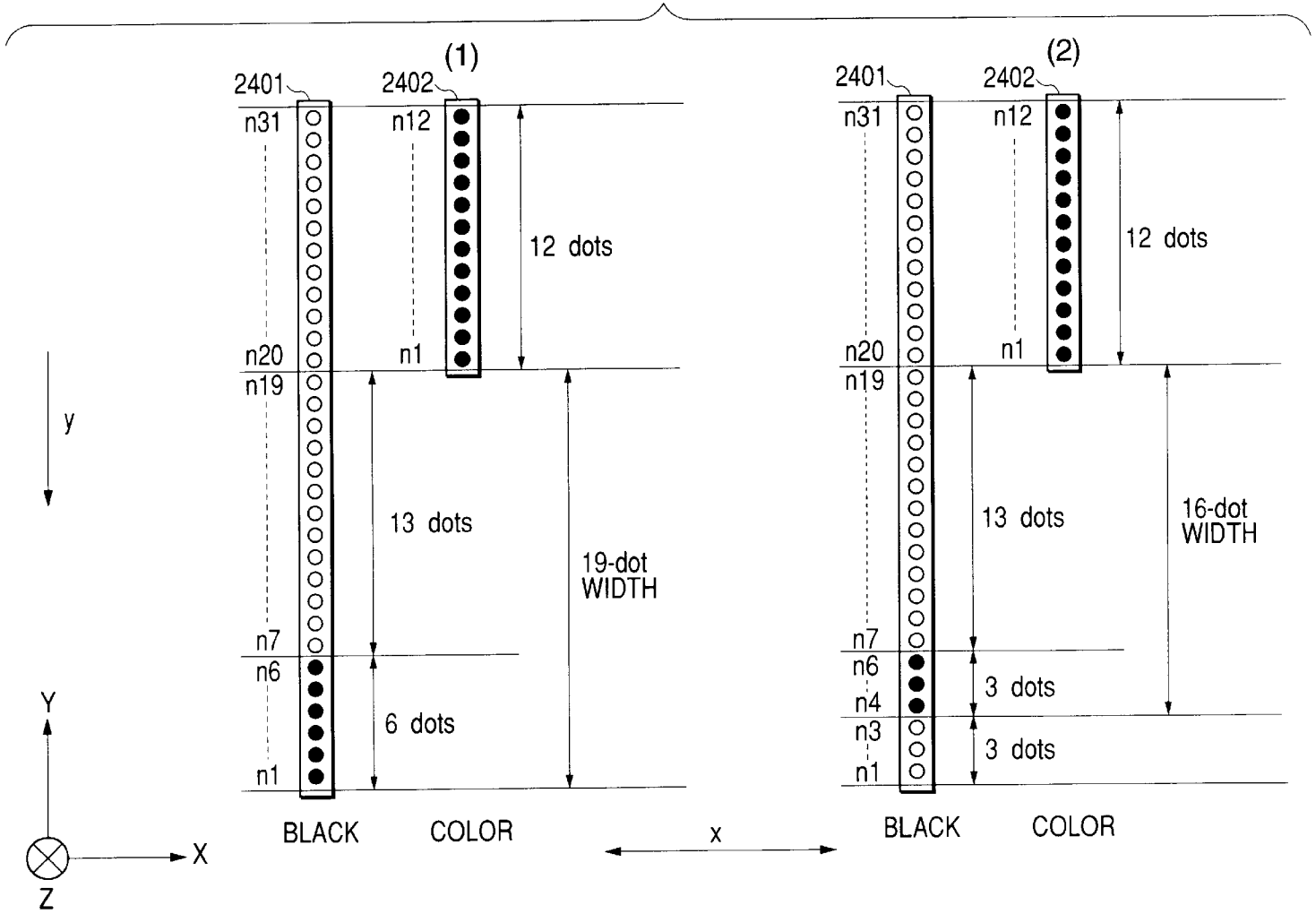
FIG. 24 is a view that schematically shows the structure of the recording head to which the fourth embodiment of the present invention is applicable.

Also, with respect to the first discharge port array that discharges black ink for the present embodiment, the position of the leading end portion of the second discharge port array for discharging color ink, which is used from the side in the sheet feeding direction of the recording medium, is set at a length of 18 dots/600 dpi as shown at (1) in FIG. 22 and 2301*a* in FIG. 23, and set at a length of 15 dots/600 dpi as shown at (2) in FIG. 22 and 2301*b* in FIG. 23. However, the length is not necessarily limited thereto. As shown in FIG. 24, if the discharge port number of the first discharge port array that discharges black ink is 31 pieces having the length of 19 dots/600 dpi as shown at (1) in FIG. 24, in which (m+a)=(1+3)=4 times (a is 3) with the amount of continuously conveying a recording medium being larger than 18 dots/600 dpi of (6+3+3+6) dots/600 dpi, and (m+a+1)=(1+3+1)=5 times [a is 3] with the amount of conveying the recording medium being smaller than 21 dots/600 dpi of (6+3+3+6+3) dots/600 dpi, and also, having the length of 16 dots/600 dpi as shown at (2) in FIG. 24, in which (m+a)=(1+3)=4 times (a is 3) with the amount of continuously conveying a recording medium being larger than 15 dots/600 dpi of (3+3+6+3) dots/600 dpi or (3+6+3+3) dots/600 dpi, and (m+a+1)=(1+3+1)=5 times (a is 3) with the amount of conveying the recording medium being smaller than 18 dots/600 dpi of (3+3+6+3+3) dots/600 dpi or 21 dots/600 dpi of (3+6+3+3+6) dots/600 dpi, then the end portion of the image completed by use of the discharge port n26 of the first recording head that discharges black ink, and the end portion of the image to be recorded by use of the discharge port n12 of the second recording head that discharges color ink are away from the present embodiment by 1 dot/600 dpi. Therefore, it becomes possible to obtain a better effect as to the prevention of bleeding between colors of black and others on the boundary portion of the recording scans.

In accordance with the present embodiment, it is possible to provide an ink jet recording apparatus, which is capable of recording high quality images by preventing bleeding between colors in the multi-pass recording method by the execution of controls described above, as well as in the recording method having two or more kinds of amounts of conveying a recording medium.

Further, there has been no particular description regarding each of the embodiments described above as to whether the recording in black ink and color ink that should be executed by the forward scan or by the backward scan in the reciprocation of the recording head. For each of the embodiments described above, it is possible to execute all the modes given below.

A first mode is such as to perform recording both in the forward scan and the backward scan. Here, in the case of the first embodiment shown in FIG. 13, the first, fifth, and seventh scans are performed forwardly, and the second, fourth, and sixth scans are performed backwardly. With this mode, it becomes possible to make the entire recording time shorter.

A second mode is such as to perform recording in either the forward scan or the backward scan. For the example shown in FIG. 13, all the first to seventh scans are performed forwardly. With this mode, it becomes possible to superpose ink equally at all times, particularly the one that forms color ink, such as magenta, yellow, and cyan. In other words, there may occur differences in the way in which ink of these three colors is superposed due to the order of three ink discharge port arrays in a case of reciprocation scans, and the resultant color tone is caused to be different in some cases. However, in the mode described here, the way each color ink is superposed is made equal to keep the color tone the same all the time.

Also, in this case, according to the example shown in FIG. 13, the scan that corresponds to the fourth scan takes a time required for the portion of a reciprocation scan, which is a time twice that taken by the aforesaid first embodiment. Thus, the time required for fixing black ink that has been used for recording prior thereto can be made longer.

A third mode is such as to reverse the scanning direction of recording by the first discharge port array (black ink) and the scanning direction of recording by the second discharge port array (color ink). With this mode, it becomes possible to make the number of elements to be driven smaller per scan with respect to each of the discharge port arrays for black ink and color ink. As a result, the capacity of power supply source can be made smaller in accordance with the driving frequency.

As described above, in accordance with the present invention, it is possible to reduce the bleeding between colors that is created characteristically in the multi-pass recording method, and further, it becomes possible to record high quality images by preventing color unevenness in the recording method provided with two or more kinds of conveying amounts of a recording medium.

What is claimed is:

1. An ink jet recording apparatus using recording means provided with a first discharge port array and a second discharge port array having a plurality of discharge ports arranged to discharge ink, respectively, for recording by discharging ink to a recording medium from the discharge ports of said recording means, comprising:

main scanning means for enabling said recording means to scan in a main scanning direction different from a direction of arrangement of said discharge port arrays relatively to the recording medium;

sub-scanning means for enabling recording medium sub-scan from an upstream side to a downstream side in a sub-scanning direction and recording control means for repeating a recording operation to perform recording by discharging ink from said recording means during the scanning of said recording means by said main scanning means, and the sub-scanning by said sub-scanning means to record images on the recording medium, wherein said recording control means performs recording scans m times (m is a positive integer) in the main scanning direction to complete an image by the first discharge port array, and recording scans n times (n is a positive integer) in the main scanning direction to complete the image by the second discharge port array, while being provided with at least two kinds of sub-scanning amounts of the recording medium in the sub-scanning direction per main scan, and with respect to discharge ports to be used for recording in the first and second discharge port arrays, a distance between discharge ports which are positioned at upstream ends of the respective first and second discharge port arrays in the sub-scan direction is made equal to a length of a continuously conveying amount of (m+a) (a is a positive integer) times by combination of the at least two kinds of conveying amounts.

2. An apparatus according to claim 1, wherein at least one of the positions of the discharge ports used for one main scan to complete an image by said first discharge port array and the discharge ports used for one main scan to complete the image by said second discharge port array is made different in accordance with the combination of the conveying amounts of (m+a) times including the next conveying amount.

3. An apparatus according to claim 1, wherein the recording scan width in the sub-scanning direction for conveying a recording medium per main scan to complete an image by said first discharge port array is equal to the recording scan width in the sub-scanning direction for conveying the recording medium per main scan to complete an image by said second discharge port array.

4. An apparatus according to claim 1, wherein the recording scan width in the sub-scanning direction for conveying a recording medium per main scan to complete an image by said first discharge port array is different from the recording scan width in the sub-scanning direction for conveying the recording medium per main scan to complete an image by said second discharge port array.

5. An apparatus according to claim 4, wherein the recording scan width in the sub-scanning direction for conveying a recording medium per main scan to complete an image by said second discharge port array is larger than the recording scan width in the sub-scanning direction for conveying the recording medium per main scan to complete an image by said first discharge port array.

6. An apparatus according to claim 1, wherein the length of said first discharge port array and the length of said second discharge port array are equal.

7. An apparatus according to claim 1, wherein the length of said first discharge port array and the length of said second discharge port array are different.

8. An apparatus according to claim 7, wherein the length of said first discharge port array is longer than the length of said second discharge port array.

9. An apparatus according to claim 1, wherein at least one of image recordings by said first discharge port array and said second discharge port array is performed in accordance with control of completing the image with plural main scans by thinning the image to be recorded.

10. An apparatus according to claim 1, wherein the Ka value of ink to be discharged from said first discharge port array by a Bristow tester is smaller than the Ka value of ink to be discharged from said second discharge port array by the Bristow tester.

11. An apparatus according to claim 1,wherein said first discharge port array discharges black ink.

12. An apparatus according to claim 1, wherein said second discharge port array discharges color ink.

13. An apparatus according to claim 12, wherein said color ink is at least one of cyan, magenta, or yellow.

14. An apparatus according to claim 1, wherein said recording means is provided with electrothermal converting elements for applying thermal energy to ink to generate bubbles in ink for discharging ink.

15. An apparatus according to claim 1, wherein the recording operation for recording by discharging ink from said recording means during the scanning of said recording means by said main scanning means includes recording in both the forward direction and the backward direction.

16. An apparatus according to claim 1, wherein the recording operation for recording by discharging ink from said recording means during the scanning of said recording means by said main scanning means includes recording in one of the forward direction and the backward direction.

17. An apparatus according to claim 1, wherein the recording direction of the first discharge port array and the recording direction of the second discharge port array are different for the recording operation for recording by discharging ink from said recording means during the scanning of said recording means by said main scanning means.

18. An ink jet recording apparatus using recording means provided with a first discharge port array and a second discharge port array having a plurality of discharge ports arranged to discharge ink, respectively, for recording by discharging ink to a recording medium from the discharge ports of said recording means, comprising:

main scanning means for enabling said recording means to scan in a main scanning direction different from a direction of arrangement of said discharge port arrays relatively to the recording medium;

sub-scanning means for enabling recording medium sub-scan from an upstream side to a downstream side in a sub-scanning direction; and recording control means for repeating a recording operation to perform recording by discharging ink from said recording means during the scanning of said recording means by said main scanning means, and the sub-scanning by said sub-scanning means to record images on the recording medium, wherein said recording control means performs recording scans m times (m is a positive integer) in the main scanning direction to complete an image by the first discharge port array, and recording scans n times (n is a positive integer) in the main scanning direction to complete the image by the second discharge port array, while being provided with at least two kinds of sub-scanning amounts of the recording medium in the sub-scanning direction per main scan, and with respect to discharge ports to be used for recording in the first and second discharge port arrays, a distance between discharge ports which are positioned at downstream ends of the respective first and second discharge port arrays in the sub-scan direction is made equal to the length of the continuously conveying amount of (m+a) (a is a positive integer) times by combination of the at least two kinds of conveying amounts.

19. An ink jet recording apparatus using recording means provided with a first discharge port array and a second discharge port array having a plurality of discharge ports arranged to discharge ink, respectively, for recording by discharging ink to a recording medium from the discharge ports of said recording means, comprising:

main scanning means for enabling said recording means to scan in a main scanning direction different from a direction of arrangement of said discharge port arrays relatively to the recording medium;

sub-scanning means for enabling recording medium sub-scan from an upstream side to a downstream side in the sub-scanning direction; and recording control means for repeating a recording operation to perform recording by discharging ink from said recording means during the scanning of said recording means by said main scanning means, and the sub-scanning by said sub-scanning means to record images on the recording medium, wherein said recording control means performs recording scans m times (m is a positive integer) in the main scanning direction to complete an image by the first discharge port array, and recording scans more than one time in the main scanning direction to complete the image by the second discharge port array, while being provided with at least two kinds of sub-scanning amounts of the recording medium in the sub-scanning direction per main scan, and with respect to discharge ports to be used for recording in the first and second discharge port arrays, a distance between discharge ports which are positioned at upstream ends of the respective first and second discharge port arrays in the sub-scan direction is made larger than the length of the continuously conveying amount of (m+a) (a is a positive integer) times by combination of the at least two kinds of conveying amounts and smaller than the length of the continuously conveying amount of(m+a+1) times by combination of the at least two kinds of conveying amounts.

20. An ink jet recording apparatus using recording means provided with a first discharge port array and a second discharge port array having a plurality of discharge ports arranged to discharge ink, respectively, for recording by discharging ink to a recording medium from the discharge ports of said recording means, comprising:

main scanning means for enabling said recording means to scan in a main scanning direction different from a direction of arrangement of the discharge port arrays relatively to the recording medium;

sub-scanning means for enabling recording medium sub-scan from an upstream side to a downstream side in a sub-scanning direction; and recording control means for repeating a recording operation to perform recording by discharging ink from said recording means during the scanning of said recording means by said main scanning means, and the sub-scanning by said sub-scanning means to record images on the recording medium, wherein said recording control means performs recording scans m times (m is a positive integer) in the main scanning direction to complete an image by the first discharge port array, and recording scans more than one time in the main scanning direction to complete the image by the second discharge port array, while being provided with at least two kinds of sub-scanning amounts of the recording medium in the sub-scanning direction per main scan, and with respect to discharge ports to be used for recording in the first and second discharge port arrays, a distance between discharge ports which are positioned at downstream ends of the respective first and second discharge port arrays in the sub-scan direction is made larger than the length of the continuously conveying amount of (m+a) (a is a positive integer) times by combination of the at least two kinds of conveying amounts and smaller than the length of the continuously conveying amount of (m+a+1) times by combination of the at least two kinds of conveying amounts.

21. An ink jet recording method for use with main scanning means using recording means having a first discharge port array and a second discharge port array with a plurality of discharge ports arranged for discharging ink, respectively, to enable said recording means to scan relatively to a recording medium and reciprocally in a main scanning direction different from a direction of arrangement of the discharge port arrays, and sub-scanning means for sub-scanning the recording medium from an upstream side to a downstream side in a sub-scanning direction for recording an image on the recording medium by repeating a recording operation for recording by discharging ink from said recording means during the scanning of said recording means by said main scanning means, and the sub-scanning by said sub-scanning means, comprising the step of:

setting a number m of recording scans (m is a positive integer) in the main scanning direction of the completion of an image by a first discharge port array, and a number n of recording scans (n is a positive integer) in the main scanning direction for the completion of the image by a second discharge port array, while providing at least two kinds of sub-scanning amounts of the recording medium in the sub-scanning direction per main scan, wherein with respect to discharge ports to be used for recording in the first and second discharge port arrays, a distance between discharge ports which are positioned at upstream ends of the respective first and second discharge port arrays in the sub-scan direction is made equal to a length of a continuously conveying amount of (m+a) (a is a positive integer) times by combination of the at least two kinds of conveying amounts.

22. A method according to claim 21, wherein the recording operation for recording by discharging ink from said recording means during the scanning of said recording means by said main scanning means includes recording in both the forward direction and the backward direction.

23. A method according to claim 21, wherein the recording operation for recording by discharging ink from said recording means during the scanning of said recording means by said main scanning means includes recording in one of the forward direction and the backward direction.

24. A method according to claim 21, wherein the recording direction of the first discharge port array and the recording direction of the second discharge port array are different for the recording operation for recording by discharging ink from said recording means during the scanning of said recording means by said main scanning means.

25. An ink jet recording apparatus using recording means provided with a first discharge port array and a second discharge port array having a plurality of discharge ports arranged to discharge ink, respectively, for recording by discharging ink to a recording medium from the discharge ports of said recording means, comprising:

main scanning means for enabling said recording means to scan in a main scanning direction different from a direction of arrangement of the discharge port arrays relatively to the recording medium;

sub-scanning means for enabling sub-scanning of the recording medium from an upstream side to a downstream side in a sub-scanning direction; and recording control means for repeating a recording operation to perform recording by discharging ink from said recording means during the scanning of said recording means by said main scanning means, and the sub-scanning by said sub-scanning means, so as to record images on the recording medium, said recording control means controlling the sub-scanning of the recording medium by using at least two kinds of sub-scan amounts, wherein said recording control means changes a discharge port group to be used for recording, which discharge port group comprises plural consecutive discharge ports of the first discharge port array, in accordance with a number of times of scans of said recording means in the main scanning direction regarding one area, for completing an image using the first discharge port array, and a position of the discharge port group of the first discharge port array to be used for recording is determined in accordance with a length for the recording medium to be conveyed by combination of the at least the two kinds of sub-scan amounts, so as to stabilize a time period between image recording by the first discharge port array and image recording by the second discharge port array.

26. An ink jet recording method for use with an ink jet recording apparatus using recording means provided with a first discharge port array and a second discharge port array having a plurality of discharge ports arranged to discharge ink, respectively, for recording by discharging ink to a recording medium from the discharge ports of the recording means, comprising:

a main scanning step of enabling the recording means to scan in a main scanning direction different from a direction of arrangement of the discharge port arrays relatively to the recording medium;

a sub-scanning step of enabling sub-scanning of the recording medium from an upstream side to a downstream side in a sub-scanning direction; and a recording control step of repeating a recording operation to perform recording by discharging ink from the recording means during the scanning of the recording means in the main scanning step, and the sub-scanning in the sub-scanning step, so as to record images on the recording medium, said recording control step controlling the sub-scanning of the recording medium by using at least two kinds of sub-scan amounts, wherein said recording control step changes a discharge port group to be used for recording, which discharge port group comprises plural consecutive discharge ports of the first discharge port array, in accordance with a number of times of scans of the recording means in the main scanning direction regarding one area, for completing an image using the first discharge port array, and a position of the discharge port group of the first discharge port array to be used for recording is determined in accordance with a length for the recording medium to be conveyed by combination of the at least two kinds of sub-scan amounts, so as to stabilize a time period between image recording by the first discharge port array and image recording by the second discharge port array.

27. An ink jet recording method for use with main scanning means using recording means having a first discharge port array and a second discharge port array with a plurality of discharge ports arranged for discharging ink, respectively, to enable said recording means to scan relatively to a recording medium and reciprocally in a main scanning direction different from a direction of arrangement of the discharge port arrays, and sub-scanning means for sub-scanning the recording medium from an upstream side to a downstream side in the a sub-scanning direction for recording an image on the recording medium by repeating a recording operation for recording by discharging ink from said recording means during the scanning of said recording means by said main scanning means, and the sub-scanning by said sub-scanning means, comprising the step of:

setting a number m of recording scans (m is a positive integer) in the main scanning direction for the completion of an image by the first discharge port array, and a number n of recording scans (n is a positive integer) in the main scanning direction for the completion of the image by the second discharge port array, while providing at least two kinds of sub-scanning amounts of a the recording medium in the sub-scanning direction per main scan, wherein with respect to discharge ports to be used for recording in the first and second discharge port arrays, a distance between discharge ports which are positioned at upstream ends of the respective first and second discharge port arrays in the sub-scan direction is made equal to the a length of the continuously conveying amount of (m+a) (a is a positive integer) times by combination of the at least two kinds of conveying amounts.

28. An ink jet recording method for use with main scanning means using recording means having a first discharge port array and a second discharge port array with a plurality of discharge ports arranged for discharging ink, respectively, to enable said recording means to scan relatively to a recording medium and reciprocally in a main scanning direction different from a direction of arrangement of the discharge port arrays, and sub-scanning means for sub-scanning the recording medium from an upstream side to a downstream side in the sub-scanning direction for recording an image on the recording medium by repeating a recording operation for recording by discharging ink from said recording means during the scanning of said recording means by said main scanning means, and the sub-scanning by said sub-scanning means, comprising the step of:

setting a number m of recording scans (m is a positive integer) in the main scanning direction for the completion of an image by the first discharge port array, and a number of recording scans in the main scanning direction to be more than one for the completion of the image by the second discharge port array, while providing at least two kinds of sub-scanning amounts of the recording medium in the sub-scanning direction per main scan, wherein with respect to discharge ports to be used for recording in the first and second discharge port arrays, a distance between discharge ports which are positioned at downstream ends of the respective first and second discharge port arrays in the sub-scan direction is made larger than the length of the continuously conveying amount of (m+a) (a is a positive integer) times by combination of the at least two kinds of conveying amounts and smaller than the length of the continuously conveying amount of (m+a+1) times by combination of the at least two kinds of conveying amounts.

29. An ink jet recording method for use with main scanning means using recording means having a first discharge port array and a second discharge port array with a plurality of discharge ports arranged for discharging ink, respectively, to enable said recording means to scan relatively to a recording medium and reciprocally in a main scanning direction different from a direction of arrangement of the discharge port arrays, and sub-scanning means for sub-scanning the recording medium from an upstream side to a downstream side in a sub-scanning direction for recording an image on the recording medium by repeating a recording operation for recording by discharging ink from said recording means during the scanning of said recording means by said main scanning means, and the sub-scanning by said sub-scanning means, comprising the step of:

setting a number m of recording scans (m is a positive integer) in the main scanning direction for the completion of an image by the first discharge port array, and a number of recording scans in the main scanning direction to be more than one for the completion of the image by the second discharge port array, while providing at least two kinds of sub-scanning amounts of the recording medium in the sub-scanning direction per main scan, wherein with respect to discharge ports to be used for recording in the first and second discharge port arrays, a distance between discharge ports which are positioned at downstream ends of the respective first and second discharge port arrays in the sub-scan direction is made larger than the length of the continuously conveying amount of(m+a) (a is a positive integer) times by combination of the at least two kinds of conveying amounts and smaller than the length of the continuously conveying amount of (m+a+1) times by combination of the at least two kinds of conveying amounts.

* * * * *

UNITED STATES PATENT AND TRADEMARK OFFICE

CERTIFICATE OF CORRECTION

PATENT NO. : 6,712,443 B2
DATED : March 30, 2004
INVENTOR(S) : Kanda et al.

It is certified that error appears in the above-identified patent and that said Letters Patent is hereby corrected as shown below:

Column 2,
Line 9, “the blank portion” should read -- blank portions --.

Column 5,
Line 30, “and” should read -- and is --.
Line 33, “and also,” should read -- and is also --.

Column 10,
Line 53, “tinning” should read -- thinning --.
Line 56, “Inside each” should read -- Each --.

Column 26,
Line 46, “that” should be deleted.

Column 32,
Line 63, “a” should be deleted.

Column 33,
Line 1, “upstream” should read -- downstream --.
Line 3, “a” should be deleted.
Line 31, “downstream” should read -- upstream --.

Signed and Sealed this

Seventh Day of December, 2004

JON W. DUDAS
*Director of the United States Patent and Trademark Office*